US009868562B2

(12) United States Patent
McDonnell et al.

(10) Patent No.: US 9,868,562 B2
(45) Date of Patent: Jan. 16, 2018

(54) BULK BIN ASSEMBLY WITH A HORIZONTAL VENTILATION INSERT AND METHOD FOR FORMING THE SAME

(71) Applicant: WestRock Shared Services, LLC, Norcross, GA (US)

(72) Inventors: William T. McDonnell, Elmhurst, IL (US); Kenneth John Shanton, West Chicago, IL (US); M. Scott Bryll, Lockport, IL (US); Timothy McCarthy, Chicago, IL (US)

(73) Assignee: WestRock Shared Services, LLC, Norcross, GA (US)

( * ) Notice: Subject to any disclaimer, the term of this patent is extended or adjusted under 35 U.S.C. 154(b) by 52 days.

(21) Appl. No.: 15/009,039

(22) Filed: Jan. 28, 2016

(65) Prior Publication Data

US 2016/0221710 A1 Aug. 4, 2016

Related U.S. Application Data

(60) Provisional application No. 62/110,179, filed on Jan. 30, 2015.

(51) Int. Cl.
*B65D 5/42* (2006.01)
*B65D 5/04* (2006.01)

(52) U.S. Cl.
CPC ..... *B65D 5/4295* (2013.01)

(58) Field of Classification Search
CPC ..... B65D 5/4295; B65D 5/04
USPC ..... 229/120, 120.34, 916, 109, 120.03, 229/120.05, 120.1; 220/913
See application file for complete search history.

(56) References Cited

U.S. PATENT DOCUMENTS 2,736,483 A * 2/1956 Moore ..... B65D 5/4295 229/120.05
2,844,294 A * 7/1958 Williams ..... B65D 5/2066 229/120.03
2,955,733 A * 10/1960 Wilson ..... B65D 5/0015 229/109
3,749,011 A * 7/1973 Abendroth ..... B41F 7/26 101/148

(Continued)

OTHER PUBLICATIONS

"Methods of Storage" by Kavita Mohite, Dec. 24, 2013. Excerpted drawing from https://www.scribd.com/document/193430383/Methods-of-Storage, downloaded Aug. 10, 2016.

(Continued)

*Primary Examiner* — Christopher Demeree
(74) *Attorney, Agent, or Firm* — WestRock IP Legal

(57) ABSTRACT

A bulk bin assembly formed from a plurality of blanks material is provided. The bulk bin assembly includes a container portion including a plurality of side walls, wherein at least one side wall has a ventilation opening defined therein. The bulk bin assembly further includes a ventilation insert including a plurality of side panels and at least one insert opening defined in at least one side panel. The ventilation insert is positioned within a cavity of the container portion such that an air flow channel defined by the plurality of side panels is in air flow communication with the ventilation opening of the container portion to permit ambient air to flow through the ventilation opening and through the insert opening.

22 Claims, 16 Drawing Sheets

(56) References Cited

U.S. PATENT DOCUMENTS

| | | | |
|---|---|---|---|
| 4,389,013 | A | 6/1983 | Hall et al. |
| 4,396,144 | A | 8/1983 | Gutierrez et al. |
| 5,275,302 | A | 1/1994 | Uitz |
| 6,740,346 | B2 | 5/2004 | Shapiro |

OTHER PUBLICATIONS

"Vented Octagonal Bulk Container," drawing from http://www.conpacsouth.com/galleries/picture-details/40VentedJPG, downloaded Aug. 10, 2016.
Vented Bin, drawing of structure believed to be used of bulk bins of spinach (source unknown).

* cited by examiner

BULK BIN ASSEMBLY WITH A HORIZONTAL VENTILATION INSERT AND METHOD FOR FORMING THE SAME

CROSS-REFERENCE TO RELATED APPLICATIONS

This application claims priority to U.S. Provisional Patent Application 62/110,179, filed Jan. 30, 2015, entitled "BULK BIN ASSEMBLY WITH A HORIZONTAL VENTILATION INSERT AND METHOD FOR FORMING THE SAME," the entire contents of which are incorporated by reference herein in their entirety.

BACKGROUND

The field of the present disclosure relates generally to packaging containers and, more particularly, to a bulk bin assembly including a ventilation insert that provides an air cooling channel within the bulk bin assembly.

Containers are frequently utilized to store and aid in transporting products. These containers can be square, hexagonal, or octagonal, for example. Moreover, at least some known bulk containers used to transport products are designed to fit a standard sized pallet. At least some products that are either stored or transported in the bulk containers degrade over time, such as perishable food products. Degradation of perishable food products is further accelerated in the presence of heat transferred to the products from an ambient environment, or from heat generated by the products themselves. Heat is generally difficult to dissipate from standard bulk containers, and can result in increased spoliation rates and transportation costs of the products stored therein.

BRIEF DESCRIPTION OF THE DISCLOSURE

In one aspect, a plurality of blanks for forming a bulk bin assembly is provided. The plurality of blanks includes a first blank, which includes a first plurality of side panels for forming side walls of a container portion of the bulk bin assembly. At least one of the first plurality of side panels includes a ventilation opening defined therein. The plurality of blanks also includes a second blank configured to couple to at least one side panel of the first plurality of side panels when the container portion is formed from the first blank. The second blank includes a second plurality of side panels for forming side walls of a ventilation insert. The second plurality of side panels at least partially define an air flow channel when the ventilation insert is formed from the second blank. When formed, the ventilation insert is positionable within the container portion such that the ventilation opening is in air flow communication with the air flow channel.

In another aspect, a bulk bin assembly is provided. The bulk bin assembly includes a container portion including a plurality of side walls defining a cavity of the container portion. At least one side wall of the plurality of side walls has at least one ventilation opening defined therein. The bulk bin assembly further includes a ventilation insert including a plurality of side panels and at least one insert opening defined in at least one of the plurality of side panels. The ventilation insert is positioned within the cavity of the container portion such that an air flow channel defined by the plurality of side panels is in air flow communication with the ventilation opening of the container portion to permit ambient air to flow through the ventilation opening and through the insert opening.

In yet another aspect, a method for forming a bulk bin assembly from a plurality of blanks is provided. The method includes forming a container portion from a first blank that includes a first plurality of side panels for forming side walls of the container portion. At least one of the first plurality of side panels includes a ventilation opening defined therein. The method also includes forming a ventilation insert from a second blank that includes a second plurality of side panels for forming side walls of the ventilation insert. At least one side panel of the second plurality of side panels includes at least one insert opening defined therein. The plurality of side panels of the ventilation insert and the at least one insert opening at least partially define an air flow channel. The method further includes positioning the ventilation insert within the container portion such that the air flow channel is in air flow communication with the ventilation opening to permit ambient air to flow through the ventilation opening and through the insert opening.

BRIEF DESCRIPTION OF THE DRAWINGS

FIG. 1 is a top plan view of a first blank of sheet material for forming a container portion of a bulk bin assembly according to one embodiment of the present disclosure.

FIG. 2 is a top plan view of a second blank sheet of material for forming a sanitary insert of the bulk bin assembly according to one embodiment of the present disclosure.

FIG. 3 is a top plan view of a third blank sheet of material for forming a bottom insert of the bulk bin assembly according to one embodiment of the present disclosure.

FIG. 4 is a top plan view of a fourth blank of sheet material for forming a ventilation insert of the bulk bin assembly according to one embodiment of the present disclosure.

FIG. 5 is a perspective view of a container assembly formed from the first, second, and third blanks as shown in FIGS. 1-3.

FIG. 6 is a close-up view of a bottom locking mechanism for the container portion as shown in FIG. 5.

FIG. 7 is a perspective view of a ventilation insert formed from the fourth blank as shown in FIG. 4.

FIG. 8 is a perspective view of the container portion, bottom insert, sanitary insert assembly, and ventilation inserts in one stage of assembly of the bulk bin assembly.

FIG. 9 is a perspective view of the container portion, bottom insert, sanitary insert assembly, and ventilation inserts in another stage of assembly of the bulk bin assembly.

FIG. 10 is a perspective view of the container assembly and the ventilation inserts in another stage of assembly of the bulk bin assembly.

FIG. 11 is a perspective view of the bulk bin assembly in a final stage of assembly.

FIG. 12 is a top plan view of an alternative embodiment of a first blank of sheet material for forming a container portion of a bulk bin assembly.

FIG. 13 is a top plan view of an alternative embodiment of a fourth blank of sheet material for forming a ventilation insert of bulk bin assembly.

FIG. 14 is a perspective view of a ventilation insert formed from the fourth blank shown in FIG. 13.

FIG. 15 is a perspective view of a container portion formed from the blank shown in FIG. 12, the bottom insert shown in FIG. 3, the sanitary insert assembly 675, and the ventilation inserts shown in FIG. 14 in a first stage of assembly of a bulk bin assembly.

FIG. 16 is a perspective view of the container portion, sanitary insert assembly, and ventilation inserts shown in FIG. 15 in a second stage of assembly of the bulk bin assembly.

FIG. 17 is a perspective view of a container assembly formed from the container portion, bottom insert, and sanitary insert assembly shown in FIG. 15 and the ventilation insert shown in FIG. 14 in a third stage of assembly of the bulk bin assembly.

FIG. 18 is a perspective view of the bulk bin assembly in a final stage of assembly.

FIG. 19 is a top plan view of an alternative embodiment of a fourth blank of sheet material for forming the ventilation insert shown in FIG. 14 of the bulk bin assembly shown in FIG. 11 or the bulk bin assembly shown in FIG. 18.

FIG. 20 is a perspective view of an alternative embodiment of a sanitary insert assembly of a bulk bin assembly.

Corresponding reference characters indicate corresponding parts throughout the several views of the drawings.

DETAILED DESCRIPTION OF THE DISCLOSURE

Figure 1:
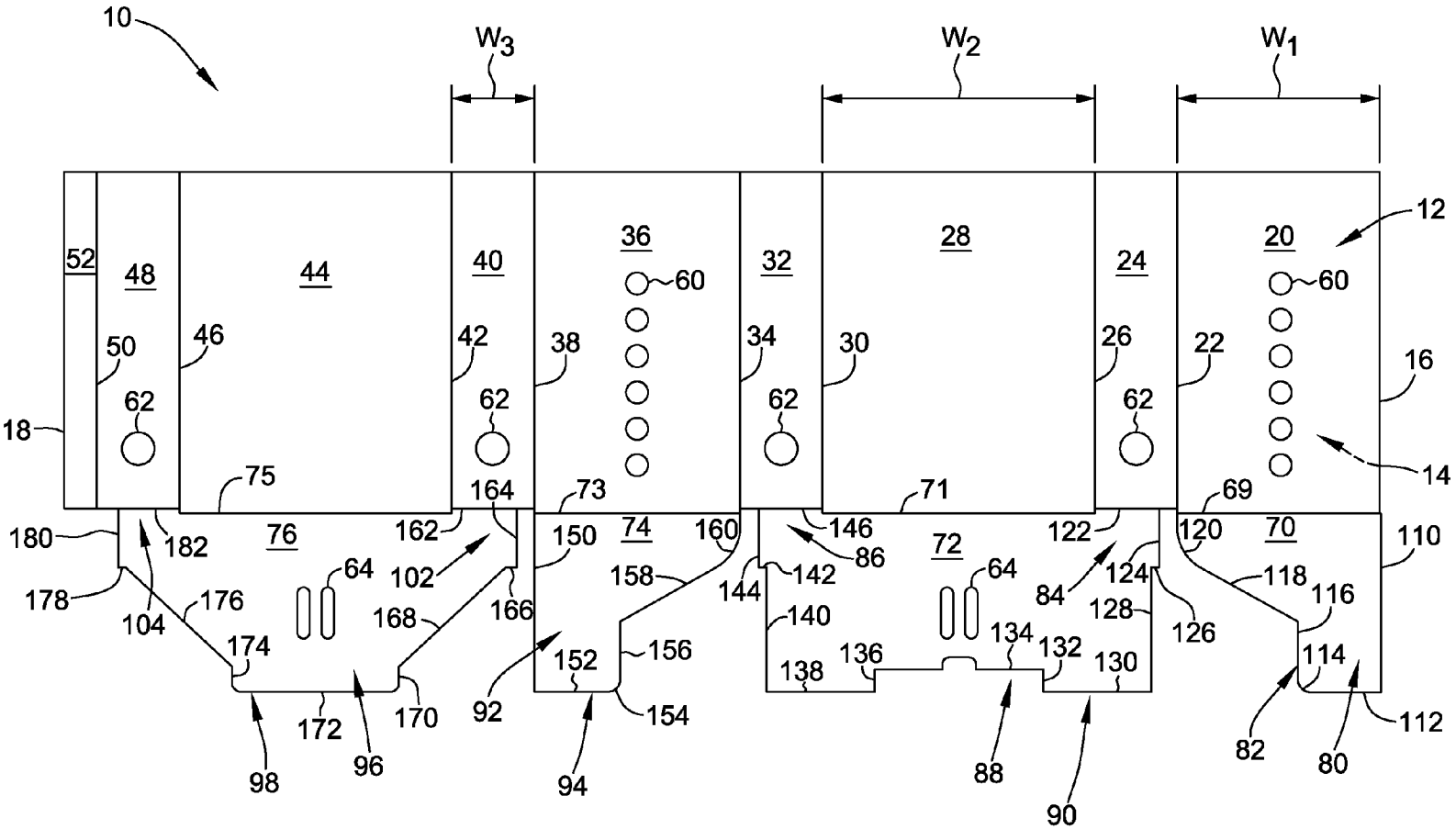
FIGS. 1-20 show example embodiments of the apparatus and methods described herein.

The following detailed description illustrates the disclosure by way of example and not by way of limitation. The description enables one skilled in the art to make and use the disclosure, describes several embodiments, adaptations, variations, alternatives, and uses of the disclosure, including what is presently believed to be the best mode of carrying out the disclosure.

A bulk bin assembly and blanks for constructing the same are described herein. More specifically, a bulk bin assembly, including a ventilation insert, and methods for forming the same are described herein. However, it will be apparent to those skilled in the art and guided by the teachings herein provided that the invention is likewise applicable to any storage container including, without limitation, a carton, a tray, a box, or a bin.

In one embodiment, the bulk bin assembly is fabricated from at least one of a corrugated board and paperboard material. The bulk bin assembly, however, may be fabricated using any suitable material, and therefore is not limited to a specific type of material. In alternative embodiments, the bulk bin assembly is fabricated using cardboard, plastic, and/or any suitable material known to those skilled in the art and guided by the teachings herein provided.

Embodiments of the present disclosure provide a bulk bin assembly for use in bulk spinach packaging, for example. However, the packaging assembly described herein could be used for packaging a variety of products, including other food or produce products. Perishable food products, such as spinach, respire subsequent to being harvested, which generates heat therefrom. Spinach is generally stored in large, 400-pound bulk containers for up to three to four days while being stored and/or transported to a destination. To compensate for the relatively high respiration rates of products such as spinach, the product-containing bulk containers undergo one or more vacuum-cooling operations to ensure the products remain fresh while being transported to distant destinations. However, vacuum cooling operations may be costly and/or may cause shipment delays.

The bulk bin assembly described herein includes a ventilation insert that facilitates providing a convective cooling channel through a central portion of the bulk container. The bulk bin assembly includes strategic openings in the side walls of the bulk container, which allow ambient air to be channeled through the container to the cooling channel and discharged from the sides of the ventilation insert. As described herein, ambient air includes surrounding environment air, such as within a cooling system in a storage warehouse or within a transportation device. As such, the bulk bin assembly described herein facilitates increasing a temperature differential and heat transfer rate within the bulk container, which may reduce the need for one or more vacuum-cooling operations.

In one embodiment, the bulk bin assembly and/or a blank includes at least one marking thereon including, without limitation, indicia that communicates the product, a manufacturer of the product, and/or a seller of the product. For example, the marking may include printed text that indicates a product's name and briefly describes the product, logos and/or trademarks that indicate a manufacturer and/or seller of the product, and/or designs and/or ornamentation that attract attention. In another embodiment, the container is void of markings, such as, without limitation, indicia that communicates the product, a manufacturer of the product, and/or a seller of the product. Furthermore, the bulk bin assembly may have any suitable size, shape, and/or configuration (i.e., number of sides), whether such sizes, shapes, and/or configurations are described and/or illustrated herein. For example, in one embodiment, the container includes a shape that provides functionality, such as a shape that facilitates transporting the container and/or a shape that facilitates stacking and/or arranging a plurality of containers.

Referring now to the drawings, FIG. 1 is a top plan view of a first blank 10 of sheet material 10 for forming a container portion 600 of a container assembly 700 (both shown in FIG. 5) for use in a bulk bin assembly 1000 (shown in FIG. 11) according to one embodiment of the present disclosure. In one embodiment, blank 10 is made of cardboard, corrugated board, plastic, and/or any other suitable material. Blank 10 has a first or interior surface 12 and an opposing second or exterior surface 14. Further, blank 10 defines a leading edge 16 and an opposing trailing edge 18. In one embodiment, from leading edge 16 to trailing edge 18, blank 10 includes a plurality of side panels for forming side walls of container portion 600. The plurality of side panels includes a first end side panel 20, a first intermediate side panel 24, a first side panel 28, a second intermediate side panel 32, a second end side panel 36, a third intermediate side panel 40, a second side panel 44, a fourth intermediate side panel 48, and a glue flap 52 coupled together along preformed, generally parallel fold lines 22, 26, 30, 34, 38, 42, 46, and 50, respectively. In the example embodiment, end side panels 20 and 36 have a first width $W_1$, side panels 28 and 44 have a second width $W_2$ greater than first width $W_1$, and intermediate side panels 24, 32, 40, and 48 have a third width $W_3$ less than first width $W_1$. However, it should be understood that the plurality of side panels can each have any suitable size, shape, and/or configuration that enables blank 10 and/or container portion 600 to function as described herein. In the example embodiment, intermediate side panels 24, 32, 40, and 48 (which may be referred to as "corner panels") are each substantially congruent; however, it should be understood that intermediate side panels 24, 32, 40, and/or 48 can each have any suitable size, shape, and/or configuration that enables blank 10 and/or container portion 600 to function as described herein.

First intermediate side panel 24 extends from first side end panel 20 along fold line 22, first side panel 28 extends from first intermediate side panel 24 along fold line 26, second intermediate side panel 32 extends from first side panel 28 along fold line 30, second end side panel 36 extends from second intermediate side panel 32 along fold line 34, third intermediate side panel 40 extends from second end side panel 36 along fold line 38, second side panel 44 extends from third intermediate side panel 40 along fold line 42, fourth intermediate side panel 48 extends from second side panel 44 along fold line 46, and glue flap 52 extends from fourth intermediate side panel 48 along fold line 50. Fold lines 22, 26, 30, 34, 38, 42, 46, and/or 50, as well as other fold lines and/or hinge lines described herein, may include any suitable line of weakening and/or line of separation known to those skilled in the art and guided by the teachings herein provided.

In the example embodiment, first and second end side panels 20, 36 include end wall vent holes 60, and intermediate side panels 24, 32, 40, and 48 include at least one side wall vent hole 62 to allow for airflow communication between a cavity of container portion 600 and an ambient environment therearound (not specifically shown). It should be understood that any panel and/or portion of blank 10 can include vent holes 60 and/or 62 having any suitable shape and/or configuration that enables container portion 600 and/or bulk bin assembly 1000 to function as described herein.

First blank 10 also includes a plurality of bottom flaps for forming a bottom wall of container portion 600. For example, first end side panel 20 includes a first bottom flap 70 extending therefrom along fold line 69, first side panel 28 includes a second bottom flap 72 extending therefrom along a fold line 71, second end side panel 36 includes a third bottom flap 74 extending therefrom along a fold line 73, and second side panel 44 includes a fourth bottom flap 76 extending therefrom along a fold line 75. Second and fourth bottom flaps 72 and 76 are major bottom flaps, and first and third bottom flaps 70 and 74 are minor bottom flaps.

In the example embodiment, first bottom flap 70 includes a first locking extension 80 defined by a free edge 82. More specifically, free edge 82 includes a first vertical portion 110, a first horizontal portion 112, a first rounded portion 114, a second vertical portion 116, a first angled portion 118, and a second rounded portion 120. First locking extension 80 is defined by first vertical portion 110, first horizontal portion 112, first rounded portion 114, and second vertical portion 116. Third bottom flap 74 is substantially a mirror image of first bottom flap 70 and includes a second locking extension 92 defined by a free edge 94. More specifically, free edge 94 includes a first vertical portion 150, a first horizontal portion 152, a first rounded portion 154, a second vertical portion 156, a first angled portion 158, and a second rounded portion 160. Second locking extension 92 is defined by first vertical portion 150, first horizontal portion 152, first rounded portion 154, and second vertical portion 156.

In the example embodiment, second bottom flap 72 includes a free edge 90 that defines a locking indentation 88. In the example embodiment, free edge 90 includes a first horizontal portion 122, a first vertical portion 124, a second horizontal portion 126, a second vertical portion 128, a third horizontal portion 130, a third vertical portion 132, a fourth horizontal portion 134, a fourth vertical portion 136, a fifth horizontal portion 138, a fifth vertical portion 140, a sixth horizontal portion 142, a sixth vertical portion 144, and a seventh horizontal portion 146. Locking indentation 88 is defined third vertical portion 132, fourth horizontal portion 134, and fourth vertical portion 136. Further, first horizontal portion 122, first vertical portion 124, and second horizontal portion 126 define a first corner projection 84. Similarly, sixth horizontal portion 142, sixth vertical portion 144, and seventh horizontal portion 146 define a second corner projection 86.

Fourth bottom flap 76 includes a free edge 98 that defines a bottom locking tab 96. In the example embodiment, free edge 98 includes a first horizontal portion 162, a first vertical portion 164, a second horizontal portion 166, a first angled portion 168, a second vertical portion 170, a third horizontal portion 172, a third vertical portion 174, a second angled portion 176, a fourth horizontal portion 178, a fourth vertical portion 180, and a fifth horizontal portion 182. Bottom locking tab 96 is defined by second vertical portion 170, third horizontal portion 172, and third vertical portion 174. Further, first horizontal portion 162, first vertical portion 164, and second horizontal portion 166 define a third corner projection 102. Similarly, fourth horizontal portion 178, fourth vertical portion 180, and fifth horizontal portion 182 define a fourth corner projection 104. Corner projections 84, 86, 102, and 104 are configured to facilitate stacking of multiple container portions 600 on top of each other.

In the example embodiment, second and fourth bottom flaps 72 and 76 include elongated ventilation slots 64 thereon. It should be understood that ventilation slots 64 may have any other suitable size, shape, and configuration. In another embodiment, only one of second and fourth bottom flaps 72 and 76 may include ventilation slots 64. Ventilation slots 64 are configured to allow ambient air to flow within a bottom of container portion 600. In another embodiment, neither of second nor fourth bottom flaps 72, 76 includes ventilation slots 64.

Figure 2:
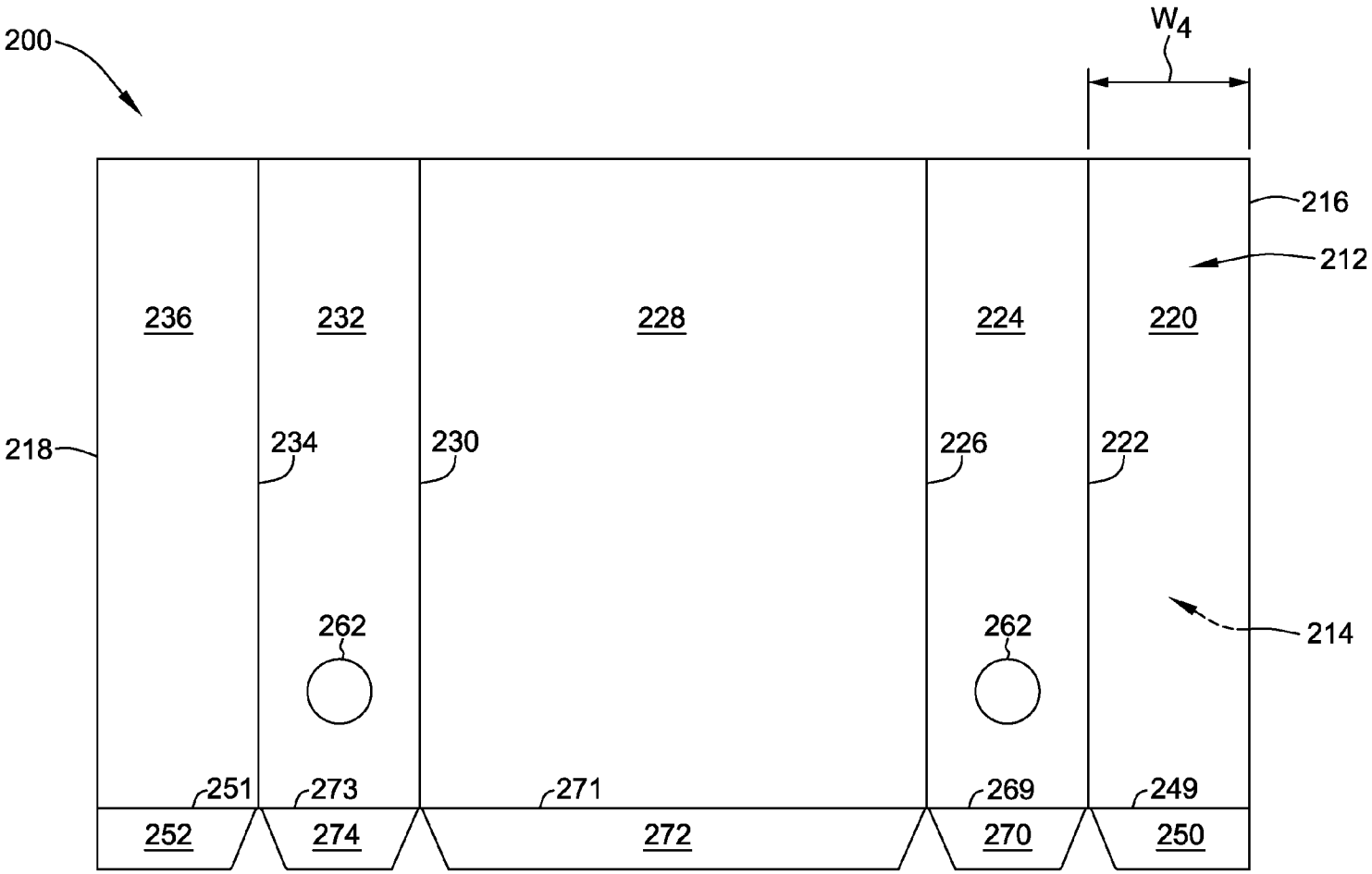

FIG. 2 is a top plan view of a second blank 200 of sheet material for forming a sanitary insert 650, 652 that may be used as part of a sanitary insert assembly 675 (both shown in FIG. 5) with bulk bin assembly 1000 (shown in FIG. 11) according to one embodiment of the present disclosure. In one embodiment, blank 200 is made of cardboard, corrugated board, plastic, and/or any other suitable material. Blank 200 has a first or interior surface 212 and an opposing second or exterior surface 214. Further, blank 200 defines a leading edge 216 and a trailing edge 218. In one embodiment, from leading edge 216 to trailing edge 218, blank 200 includes a plurality of side panels including a first partial end side panel 220, a first intermediate side panel 224, a side panel 228, a second intermediate side panel 232, and a second partial end side panel 236 coupled together along preformed, generally parallel fold lines 222, 226, 230, and 234, respectively. First intermediate side panel 224 extends from first partial end side panel 220 along fold line 222, side panel 228 extends from first intermediate side panel 224 along fold line 226, second intermediate side panel 232 extends from side panel 228 along fold line 230, and second partial end side panel 236 extends from second intermediate side panel 232 along fold line 234.

The plurality of side panels of blank 200 can each have any suitable size, shape, and/or configuration that enables sanitary inserts 650, 652 and/or sanitary insert assembly 675 to function as described herein. As described further therein, the plurality of side panels of blank 200 substantially align with the plurality of side panels of blank 10 when container portion 600 is formed from blank 10 and sanitary insert assembly 675 is formed from blanks 200 and inserted into container portion 600, or when bulk bin assembly 1000 is formed. The plurality of side panels of blank 200 thereby form a set of secondary walls of container portion 600 that can be removed after every use, facilitating reuse of container portion 600 in a more sanitary manner. Moreover, sanitary insert assembly 675 may also form reinforced side walls for bulk bin assembly 1000.

In the example embodiment, intermediate side panels 224 and 232 (which may be referred to as "corner panels") are sized such that intermediate side panels 224 and 232 of first sanitary insert 650 of sanitary insert assembly 675 substantially align with intermediate side panels 24 and 32 when bulk bin assembly 1000 is formed. Similarly, intermediate side panels 224 and 242 of second sanitary insert 652 of sanitary insert assembly 675 substantially align with intermediate side panels 40 and 48 when bulk bin assembly 1000 is formed. Moreover, side panel 228 of blank 200 is sized such that side panel 228 of first sanitary insert 650 substantially aligns with first side panel 28, and, similarly, side panel 228 of second sanitary insert 652 substantially aligns with second side panel 44, when bulk bin assembly 1000 is formed.

In the example embodiment, first and second partial end side panels 220 and 236 are sized such that first partial end side panel 220 of first sanitary insert 650 and second partial end side panel 236 of second sanitary insert 652 are coupled against first end side panel 20 without obstructing end wall vent holes 60 when bulk assembly 1000 is formed. Accordingly, first and second partial end side panels 220 and 236 have a width $W_4$ that is less than half of a width $W_1$ of first and second end side panel 20 and 36 of blank 10.

In the example embodiment, first and second intermediate side panels 224 and 232 include side wall vent holes 262. Side wall vent holes 262 are configured such that, when bulk bin assembly 1000 is formed, side wall vent holes 262 of first and second sanitary inserts 650 and 652 are substantially aligned with side wall vent holes 62 of formed container portion 600. In other words, side wall vent holes 262 are substantially congruent to side wall vent holes 62 of blank 10. Such alignment of side wall vent holes 62 of container portion 600 with side wall vent holes 262 of sanitary inserts 650, 652 ensures flow communication of a cavity of bulk bin assembly 1000 with an ambient environment.

Blank 200 also includes a plurality of locking flaps, each extending from a bottom edge of a respective side panel of the plurality of side panels of blank 200. More specifically, a first locking flap 250 extends from first partial end side panel 220 along a fold line 249, a second locking flap 270 extends from first intermediate side panel 224 along a fold line 269, a third locking flap 272 extends from side panel 228 along a fold line 271, a fourth locking flap 274 extends from second intermediate side panel 232 along a fold line 273, and a fifth locking flap 252 extends from second partial end side wall 236 along a fold line 251.

In the example embodiment described herein, when first and second sanitary inserts 650, 652 of sanitary insert assembly 675 are coupled within container portion 600, exterior surfaces 214 of the plurality of locking flaps 250, 252, 270, 272, and 274 are positioned directly adjacent to an interior surface of a bottom wall of container portion 600 formed by bottom flaps 70, 72, 74, and 76 of blank 10. In the example embodiment, as described further herein, a bottom insert 400 (shown in FIG. 3) is subsequently coupled to container portion 600, such that locking flaps 250, 252, 270, 272, and 274 are disposed between the bottom wall of container portion 600 and bottom insert 400.

Figure 3:
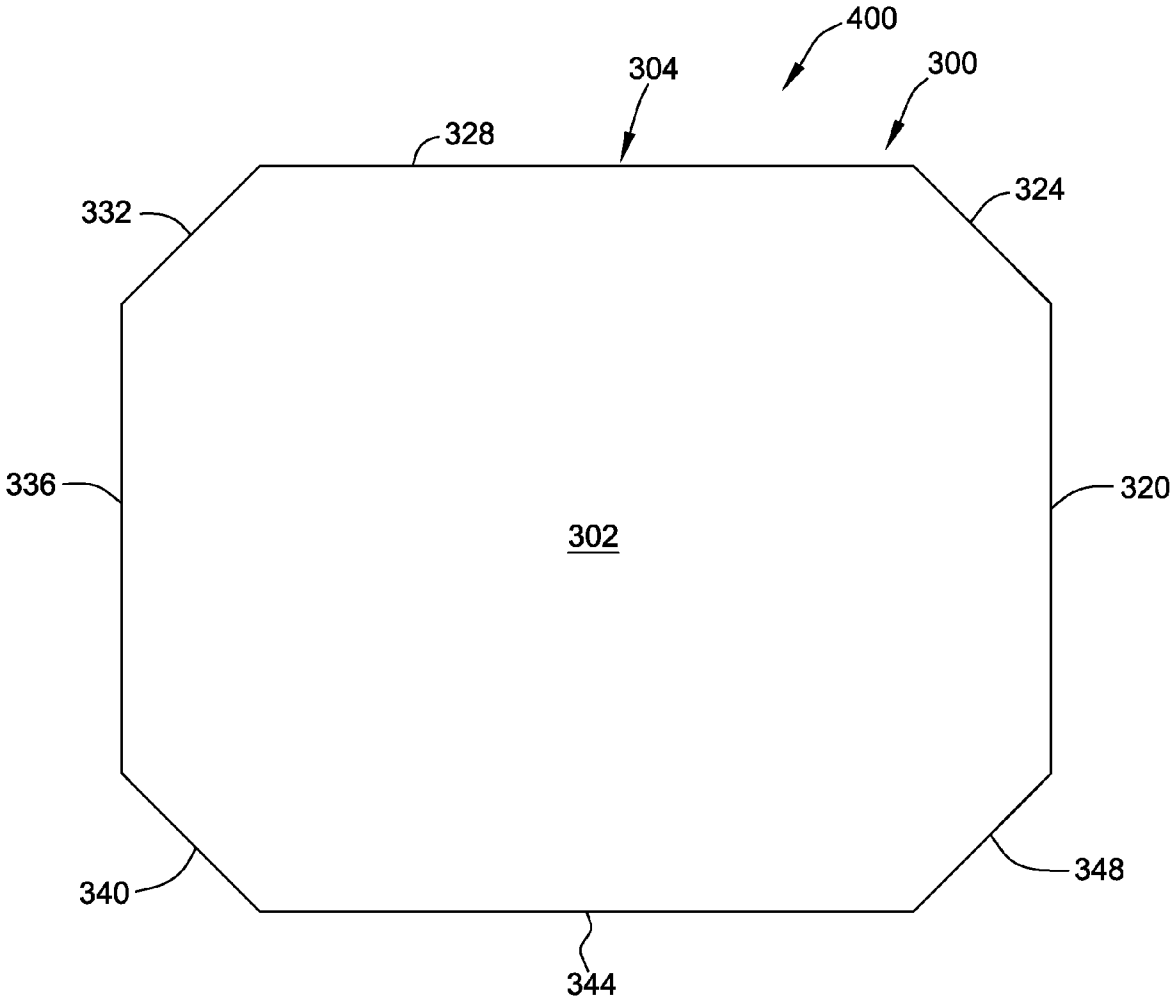

FIG. 3 is a top plan view of a third blank 300 of sheet material for forming a bottom insert 400 that may be used with bulk bin assembly 1000 (shown in FIG. 11) according to one embodiment of the present disclosure. Blank 300 is made of cardboard, corrugated board, plastic, and/or any other suitable material. Blank 300 includes a bottom panel 302 defined by a free edge 304. In the example embodiment, free edge 304 includes a plurality of side edges including a first side edge 320, a second side edge 324, a third side edge 328, a fourth side edge 332, a fifth side edge 336, a sixth side edge 340, a seventh side edge 344, and an eight side edge 348. In the example embodiment, free edge 304, and therefore bottom panel 302, are sized and shaped such that when bulk bin assembly 1000 is formed by inserting bottom insert 400 into formed container portion 600 (shown in FIG. 5), bottom insert 400 fits within container portion 600. Further, each of the plurality of side edges of bottom panel 402 couples against either a respective wall of the side walls of formed container portion 600 or a respective panel of the side panels of a sanitary insert 650, 652 (shown in FIG. 5). More specifically, first side edge 320 is sized to substantially align with and/or couple against first end side panel 20 of blank 10, second side edge 324 is sized to substantially align with and/or couple against first intermediate side panel 224 of blank 200, third side edge 328 is sized to substantially align with and/or couple against side panel 228, fourth side edge 332 is sized to substantially align with and/or couple against second intermediate side panel 232, fifth side edge 336 is sized to substantially align with and/or couple against second end side panel 36 of blank 10, sixth side edge 340 is sized to substantially align with and/or couple against first intermediate side panel 224 of blank 200, seventh side edge 344 is sized to substantially align with and/or couple against side panel 228, and eighth side edge 348 is sized to substantially align with and/or couple against second intermediate side panel 232 when bulk bin assembly 1000 is formed by inserting bottom insert 400 into formed container portion 600.

In the example embodiment described herein, bottom insert 400 is configured to reinforce a bottom wall of container portion 600 in bulk bin assembly 1000 and/or ensure that sanitary inserts 650, 652 remain coupled within container portion 600. In some other embodiments, bulk bin assembly 1000 may not include bottom insert 400.

Figure 4:
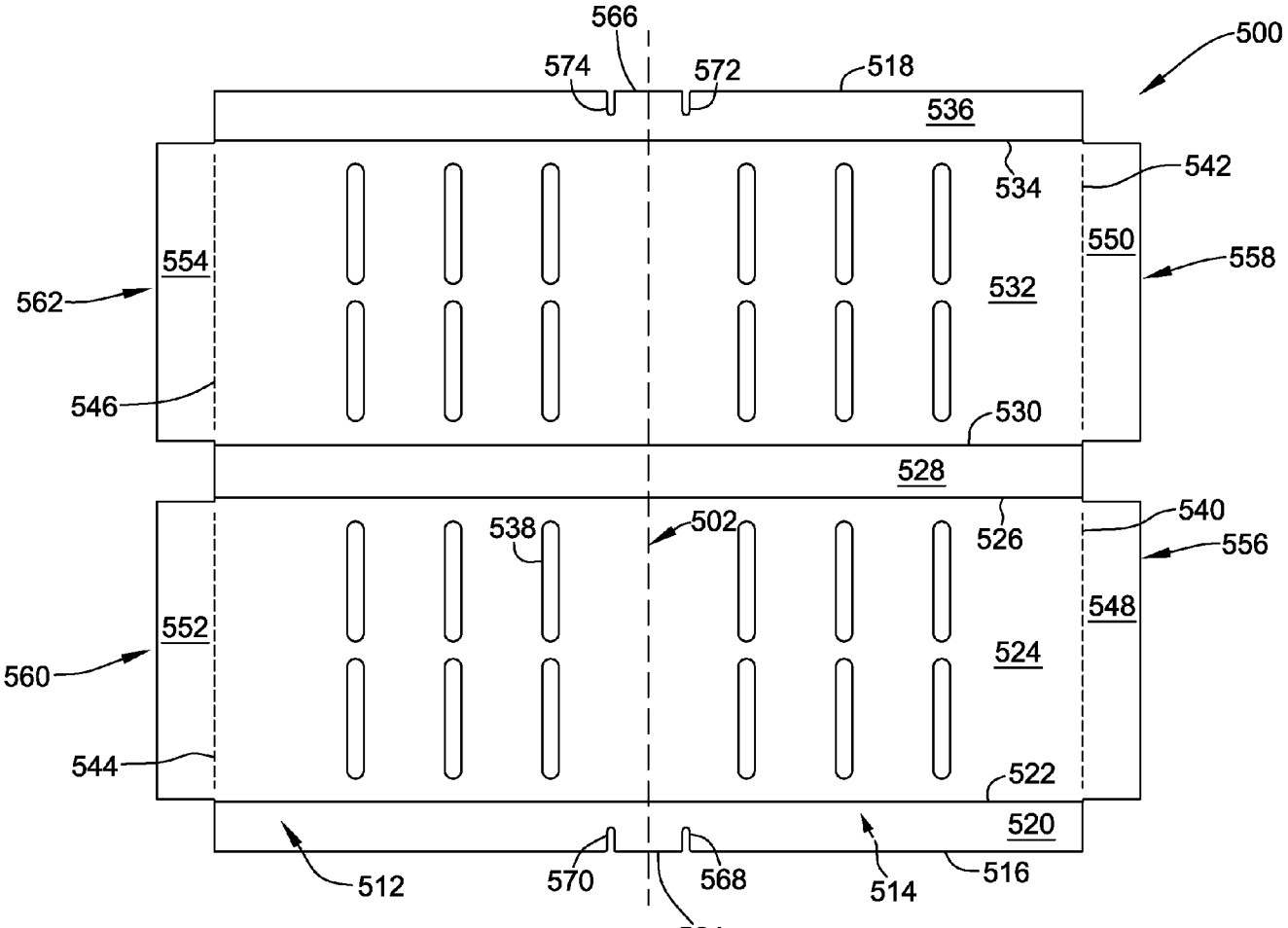

FIG. 4 is a top plan view of a fourth blank of sheet material 500 for forming a ventilation insert 800 (shown in FIG. 7) for bulk bin assembly 1000 (shown in FIG. 11) according to one embodiment of the present disclosure. Blank 500 has a first or interior surface 512 and an opposing second or exterior surface 514. Further, blank 500 defines a leading edge 516 and an opposing trailing edge 518. In the example embodiment, blank 500 includes, from leading edge 516 to trailing edge 518, an outer top insert panel 520, a first insert side panel 524, an insert bottom panel 528, a second insert side panel 532, and an inner top insert panel 536 coupled together in series along a plurality of preformed, generally parallel fold lines 522, 526, 530, and 534. More specifically, first insert side panel 524 extends from outer top insert panel 520 along fold line 522, insert bottom panel 528 extends from first insert side panel 524 along fold line 526, second insert side panel 532 extends from insert bottom panel 528 along fold line 530, and inner top insert panel 536 extends from second insert side panel 532 along fold line 534.

In the example embodiment, each of first insert side panel 524 and second insert side panel 532 includes a plurality of elongated insert openings 538. It should be understood that in alternative embodiments, insert openings 538 can have any suitable shape and/or configuration, and any panel and/or portion of blank 500 can include insert openings 538. In the example embodiment, insert openings 538 are arranged symmetrically about a longitudinal axis 502 that bisects blank 500, in order to provide even air circulation throughout container portion 600 (shown in FIG. 5) of bulk bin assembly 1000 when ventilation insert 800 is formed from blank 500 and inserted into container portion 600.

In the example embodiment, outer top insert panel 520 includes a first cutout 568, a first insert securing tab 564, and a second cutout 570 defined in leading edge 516. Similarly, inner top insert panel 536 includes a third cutout 572, a second insert securing tab 566, and a second cutout 574 defined in trailing edge 518. Cutouts 568, 570, 572, and 574 are configured to facilitate folding and/or bending of one or both of first and second insert securing tabs 564, 566. When ventilation insert 800 is formed from blank 500, second insert securing tab 566 is configured to be folded towards an interior cavity or cooling channel 820 (also referred to as an "air flow channel," shown in FIG. 7) of ventilation insert 800, and exterior surface 514 of first insert securing tab 564 is configured to be coupled against exterior surface 514 of second insert securing tab 566, urging interior 512 of second insert securing tab 566 towards interior surface 512 of inner top insert panel 536. In some embodiments, exterior surface 514 of first insert securing tab 564 includes an adhesive to adhere first insert securing tab 564 to second insert securing tab 566, thereby facilitating secure closure of ventilation insert 800. It should be understood that the securing roles of first and second securing tabs 564 and 566, as described herein, may be reversed in alternative embodiments.

First insert side panel 524 includes a first insert locking tab 548 and a third insert locking tab 552 extending therefrom along opposing fold lines 540 and 544, respectively. More specifically, first insert locking tab 548 extends from first insert side panel 524 along fold line 540 to a free edge 556, and third insert locking tab 552 extends from first insert side panel 524 along fold line 544 to a free edge 560. Similarly, second insert side panel 532 includes a second insert locking tab 550 and a fourth insert locking tab 554 extending therefrom along opposing fold lines 542 and 546, respectively. More specifically, second insert locking tab 550 extends from second insert side panel 532 along fold line 542 to a free edge 558, and fourth insert locking tab 554 extends from second insert side panel 532 along fold line 546 to a free edge 562. As described herein, insert locking tabs 548, 550, 552, and 554 are configured to be positioned and/or coupled between exterior surface 214 of one of sanitary inserts 650, 652 (shown in FIG. 5) and an interior surface of container portion 600 when bulk bin assembly 1000 is formed from blanks 10, 200, 300, and 500.

Figure 5:
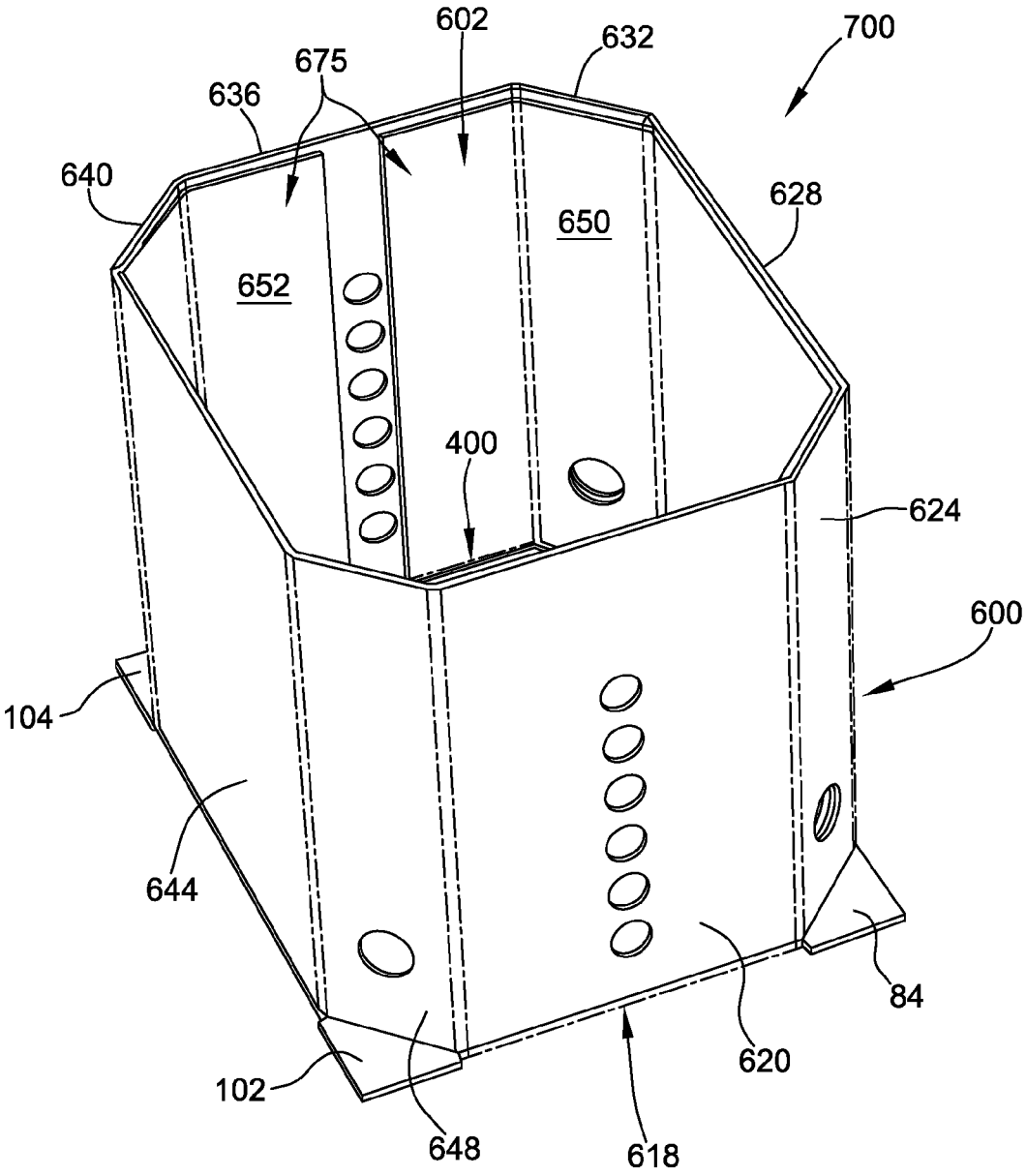

FIG. 5 is a perspective view of a container assembly 700 formed from first blank 10, two second blanks 200, and third blank 400 as shown in FIGS. 1, 2, and 3, respectively. To construct container assembly 700, container portion 600 is formed from blank 10; sanitary insert assembly 675 is formed from two blanks 200; and container portion 600, bottom insert 400, and sanitary insert assembly 675 are coupled to each other.

More specifically, to construct container portion 600 from blank 10, first end side panel 20 is rotated about fold line 22 toward interior surface 12 of first intermediate side panel 24, first intermediate side panel 24 is rotated about fold line 26 toward interior surface 12 of first side panel 28, first side panel 28 is rotated about fold line 30 toward interior surface 12 of second intermediate side panel 32, second intermediate side panel 32 is rotated about fold line 34 toward interior surface 12 of second end side panel 36, second end side panel 36 is rotated about fold line 38 toward interior surface 12 of third intermediate side panel 40, third intermediate side panel 40 is rotated about fold line 42 toward interior surface 12 of second side panel 44, second side panel 44 is rotated about fold line 46 toward interior surface 12 of fourth intermediate side panel 48, and glue flap 52 is rotated about fold line 50 toward interior surface 12 of fourth intermediate side panel 48. In the example embodiment, after rotating panels 20, 24, 28, 32, 36, 40, 44, and 48, and glue flap 52 about fold lines 22, 26, 30, 34, 38, 42, 46, and 50, end side panels 20 and 36 and glue flap 52 are substantially parallel to each other and substantially perpendicular to side panels 28 and 44; and first intermediate side panel 24 and third intermediate side panel 40 are substantially parallel to each other and substantially perpendicular to second intermediate side panel 32 and fourth intermediate side panel 48. Panels 20, 24, 28, 32, 36, 40, 44, and 48, and glue flap 52 can be rotated about fold lines 22, 26, 30, 34, 38, 42, 46, and 50 by hand or, alternatively, by wrapping blank 10 about a mandrel within a machine.

Once panels 20, 24, 28, 32, 36, 40, 44, and 48, and glue flap 52 are rotated about fold lines 22, 26, 30, 34, 38, 42, 46, and 50, glue flap 52 is coupled to first end side panel 20. For example, in the example embodiment, exterior surface 14 of glue flap 52 is adhered to interior surface 12 of first end side panel 20. Alternatively, interior surface 12 of glue flap 52 is adhered to exterior surface 14 of first end side panel 20. Further, although adhesive is described herein, glue flap 52 can be coupled to first end side panel 20 using any suitable fastener and/or technique. In the example embodiment, once glue flap 52 is coupled to first end side panel 20, first end side panel 20 and glue flap 52 form a first end wall 620, and second end side panel 36 forms a second end wall 636. Similarly, first side panel 28 forms a first side wall 628, and second side panel 44 forms a second side wall 644. First intermediate side panel 24 forms a first intermediate side wall 624, second intermediate side panel 32 forms a second intermediate side wall 632, third intermediate side panel 40 forms a third intermediate side wall 640, and fourth intermediate side panel 48 forms a fourth intermediate side wall 648. From this configuration, partially formed container portion 600 can be collapsed into a knocked-down flat configured for shipping and/or storage of container portion 600.

To continue construction of container portion 600, second bottom flap 72 is rotated about fold line 71 toward interior surface 12 of first side panel 28 into a substantially perpendicular with first side panel 28. First bottom flap 70 is rotated about fold line 69 toward interior surface 12 of first end side panel 20 and into face-to-face relationship with second bottom flap 72. Similarly, second bottom end side panel 74 is rotated about fold line 73 toward interior surface 12 of second end side panel 36 and into face-to-face relationship with second bottom flap 72. More specifically, interior surface 12 of first and third bottom flaps 70 and 74 is directly adjacent to and/or in direct contact with at least a portion of exterior surface 14 of second bottom flap 72. A locking slot 192 (shown in FIG. 6) is defined by locking indentation 88 and locking extensions 80 and 92.

Fourth bottom flap 76 is then rotated about fold line 75 toward interior surface 12 of second side panel 44. Fourth bottom flap 76 is rotated toward second bottom flap 72 and first and third bottom flaps 70 and 74 until bottom flaps 70, 72, 74, and 76 are rotated slightly upwardly into container portion 600. More specifically, bottom flaps 70, 72, 74, and 76 are rotated such that bottom locking tab 96 can be inserted into locking slot 192. Once bottom locking tab 96 is inserted into locking slot 192, bottom flaps 70, 72, 74, and 76 rotate outwardly to be substantially perpendicular to side panels 20, 24, 28, 32, 36, 40, 44, and 48 and glue flap 52. When bottom flaps 70, 72, 74, and 76 are in the substantially perpendicular configuration, bottom flaps 70, 72, 74, and 76 are locked together to form a bottom wall 618 of container portion 600. Intermediate side walls 624, 632, 640, and 648, side walls 628 and 644, end walls 620 and 636 (all collectively referred to as "side walls"), and bottom wall 618 define a cavity 602 of container portion 600.

Sanitary insert assembly 675 includes a first sanitary insert 650 and a second sanitary insert 652. To construct each sanitary insert 650, 652 from a blank 200, first partial end side panel 220 is rotated about fold line 222 toward interior surface 212 of first intermediate side panel 224, first intermediate side panel 224 is rotated about fold line 226 toward interior surface 212 of side panel 228, side panel 228 is rotated about fold line 230 toward interior surface 212 of second intermediate side panel 232, and second intermediate side panel 232 is rotated about fold line 234 toward interior surface 212 of second partial end side panel 236. In the example embodiment, after rotating panels 220, 224, 228, 232, and 236 about fold lines 222, 226, 230, and 234, partial end side panels 220 and 236 are substantially parallel to each other and perpendicular to side panel 228; and first intermediate side panel 224 is substantially perpendicular to second intermediate side panel 232. Panels 220, 224, 228, 232, and 236 may be rotated about fold lines 222, 226, 230, and 234 by hand or, alternatively, by wrapping blank 200 about a mandrel within a machine.

To continue construction of sanitary insert 650, 652, first locking flap 250 is rotated about fold line 249 toward interior surface 212 of first partial end side panel 220, second locking flap 270 is rotated about fold line 269 toward interior surface 212 of first intermediate side panel 224, third locking flap 272 is rotated about fold line 271 toward interior surface 212 of side panel 228, fourth locking flap 274 is rotated about fold line 273 toward interior surface 212 of second intermediate side panel 232, and fifth locking flap 252 is rotated about fold line 251 toward interior surface 212 of second partial end side panel 236. Locking flaps 250, 252, 270, 272, and 274 are rotated about fold lines 249, 251, 269, 271, and 273 to be substantially perpendicular to panels 220, 224, 228, 232, and 236. As used herein, "sanitary insert assembly" refers to a liner that is used to minimize contamination of side walls 62, 624, 628, 632, 636, 644, and 648 of container portion 600 from the food products or other products stored therein. Sanitary insert assembly 675 enables container portion 600 to be reused. In one embodiment, sanitary insert assembly 675 is disposable after use such that container portion 600 can be reused. Sanitary insert assembly 675 does not have to be "sterile" to function properly.

In the example embodiment, to construct container assembly 700 from container portion 600, bottom insert 400, and sanitary insert assembly 675, sanitary assembly 675 (including first and second sanitary inserts 650, 652) is coupled to container portion 600. First sanitary insert 650 of sanitary insert assembly 675 is inserted into container portion 600 such that locking flaps 250, 252, 270, 272, and 274 are adjacent to and/or in direct contact with bottom wall 618 of container portion 600; and panels 220, 224, 228, 232, and 236 are adjacent to and/or in direct contact with an interior surface of side walls 620, 624, 628, 632, and 636, respectively. In a similar fashion, second sanitary insert 652 of sanitary insert assembly 675 is inserted into container portion 600 such that locking flaps 250, 252, 270, 272, and 274 are adjacent to and/or in direct contact with bottom wall 618; and panels 220, 224, 228, 232, and 236 are adjacent to and/or in direct contact with an interior surface of side walls 620, 648, 644, 640, and 636, respectively.

In the example embodiment, sanitary insert assembly 675 remains coupled to container portion 600 by inserting bottom insert 400 into container portion 600 to be adjacent to and in direct contact with at least a portion of bottom wall 618. Bottom insert 400 may adhered to bottom wall 618 or, additionally or alternatively, may be coupled to container portion 600 adjacent to bottom wall 618 using a friction fit or any other suitable method and/or technique. Further, bottom insert 400 may be coupled to bottom wall 618 by the weight of the product contained in bulk bin assembly 1000. In other embodiments, first sanitary insert 650 and/or second sanitary insert 652 is adhered to bottom wall 618 of container portion 600 using adhesive disposed between locking flaps 250, 252, 270, 272, and 274 and bottom wall 618, and container assembly 700 may or may not include bottom insert 400.

Figure 6:
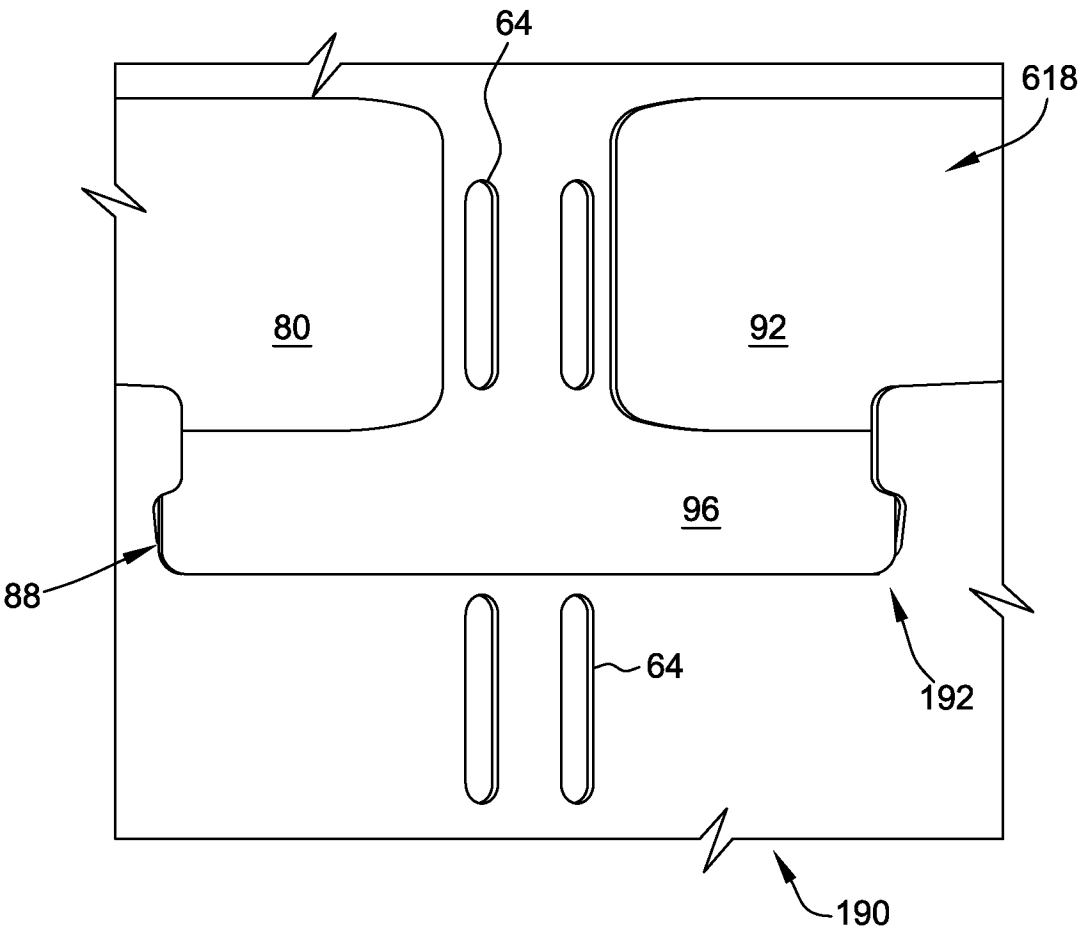

FIG. 6 is a close-up view of a bottom locking mechanism 190 of container portion 600 (shown in FIG. 5). In the illustrated embodiment, bottom locking mechanism 190 includes bottom locking tab 96, locking indentation 88, and locking extensions 80 and 92 of blank 10 (all shown in FIG. 1). Locking indentation 88 and locking extensions 80 and 92 are configured to define a locking slot 192. Alternatively, bottom locking mechanism 190 may include any suitable components and/or configuration that enables container portion 600 to be formed from blank 10. As described above, bottom locking mechanism 190 interlocks second and fourth bottom flaps 72 and 76 and first and third flaps 70 and 74 to form bottom wall 618 (shown in FIG. 5) of container portion 600.

Figure 7:
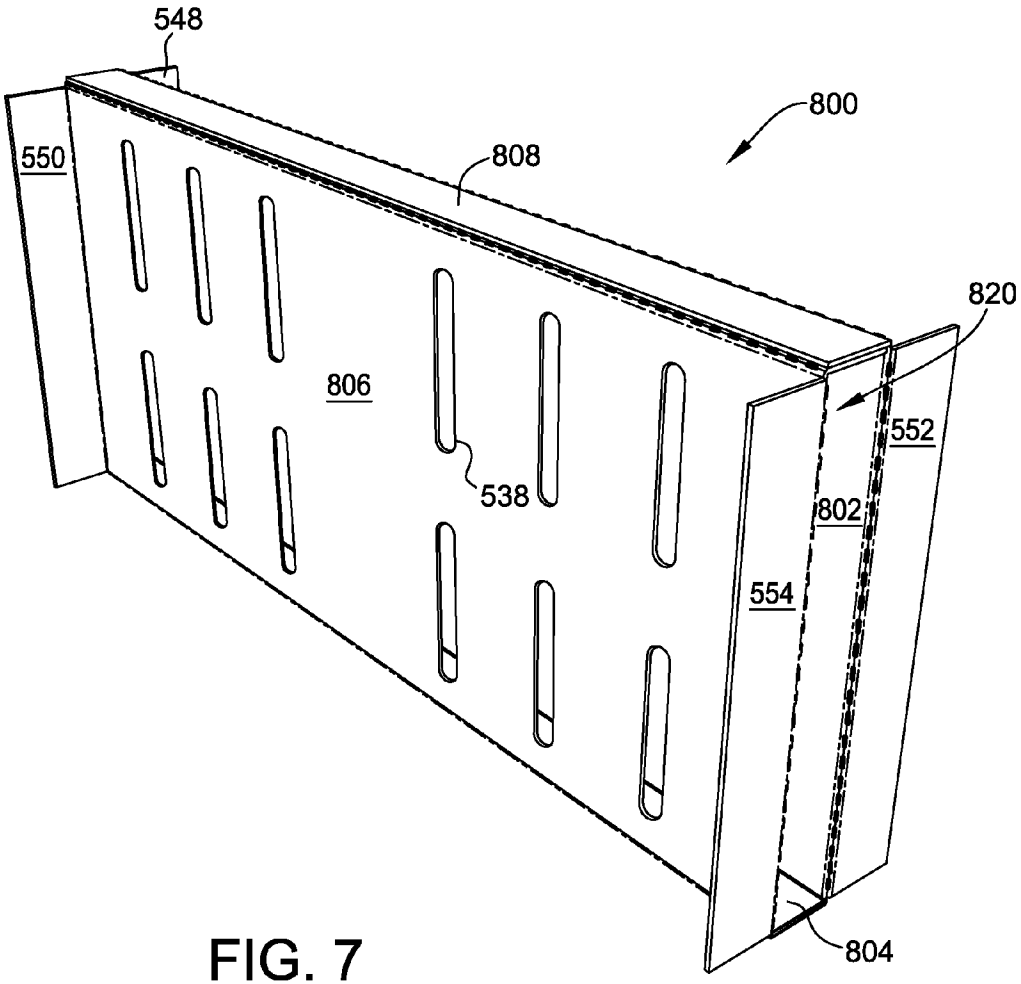

FIG. 7 is a perspective view of a ventilation insert 800 formed from the fourth blank 500 as shown in FIG. 4. Referring to FIGS. 4 and 7, to construct ventilation insert 800 from blank 500, outer top insert panel 520 is rotated about fold line 522 toward interior surface 512 of first insert side panel 524, first insert side panel 524 is rotated about fold line 526 toward interior surface 512 of insert bottom panel 528, insert bottom panel 528 is rotated about fold line 530 toward interior surface 512 of second insert side panel 532, and inner top insert panel 536 is rotated about fold line 534 toward interior surface of second insert side panel 532. In the example embodiment, after rotating panels 520, 524, 528, 532, and 536 about fold lines 522, 526, 530, and 534, insert bottom panel 528 is substantially parallel to outer top insert panel 520 and inner top insert panel 536 and substantially perpendicular to insert side panels 524 and 532.

Once panels 520, 524, 528, 532, and 536 are rotated about fold lines 522, 526, 530, and 534, outer top insert panel 520 is coupled to inner top insert panel 536. For example, in the example embodiment, interior surface 512 of outer top insert panel 520 is adhered to exterior surface 514 of inner top insert panel 536. Moreover, as described above with respect to FIG. 4, exterior surface 514 of first insert securing tab 564 is adhered to exterior surface 514 of second insert securing tab 566. Further, although adhesive is described herein, outer top insert panel 520 can be coupled to inner top insert panel 536 using any suitable fastener and/or technique. In the example embodiment, once outer top insert panel 520 is coupled to inner top insert panel 536, first insert side panel 524 forms a first insert side wall 802, insert bottom panel 528 forms an insert bottom wall 804, second insert side panel 532 forms a second insert side wall 806, and outer top insert panel 520 and inner top insert panel 536 form an insert top wall 808. First insert side wall 802, insert bottom wall 814, second insert side wall 806, and insert top wall 808 define a cavity or cooling channel 820 of ventilation insert 800.

To continue construction of ventilation insert 800, first insert locking tab 548 is rotated about fold line 540 toward exterior surface 514 of first insert side panel 524, second insert locking tab 550 is rotated about fold line 542 toward exterior surface 514 of second insert side panel 532, third insert locking tab 552 is rotated about fold line 544 toward exterior surface 514 of first insert side panel 524, and fourth insert locking tab 554 is rotated about fold line 546 toward exterior surface 514 of second insert side panel 532. Once insert locking tabs 548, 550, 552, and 554 are rotated about fold lines 540, 542, 544, and 546, insert locking tabs 548, 550, 552, and 544 are substantially parallel to each other and substantially perpendicular to insert side walls 802 and 806.

In the example embodiment, blank 500, and therefore ventilation insert 800, is made of reinforced and/or double-thickness cardboard, corrugated board, plastic, and/or any other suitable material. Ventilation insert 800 is reinforced in order that, upon introduction and/or removal of product into bulk bin assembly 1000, ventilation insert 800 remains substantially intact. In one embodiment, two ventilation inserts 800 are coupled together before assembly of bulk bin assembly 1000. More specifically, insert bottom wall 804 of a first ventilation insert 800 is adhered, fastened, or otherwise coupled to insert top wall 808 of a second ventilation insert 800.

Figure 8:
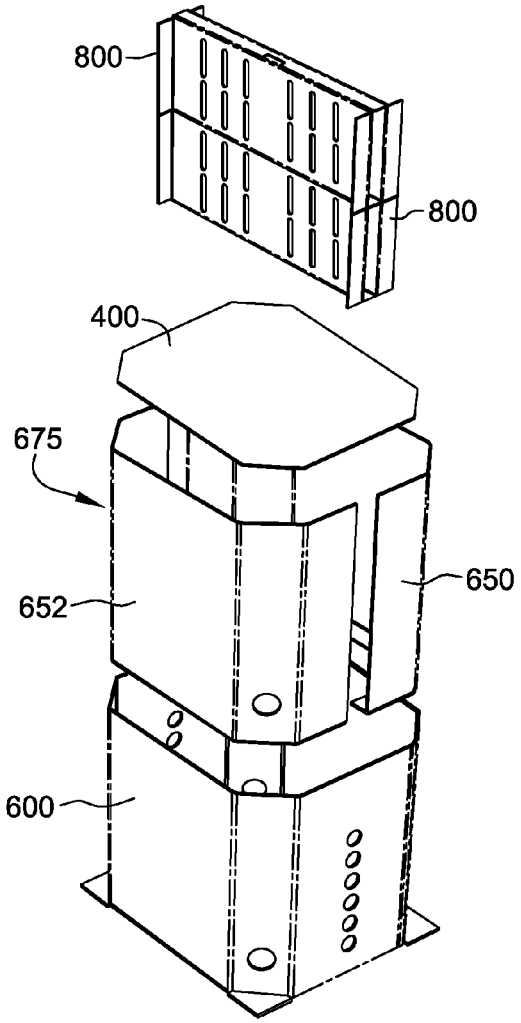
Figure 9:
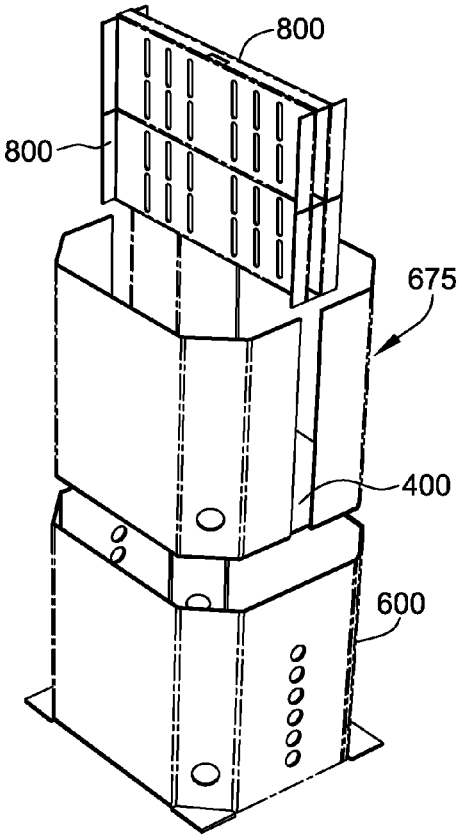
Figure 11:
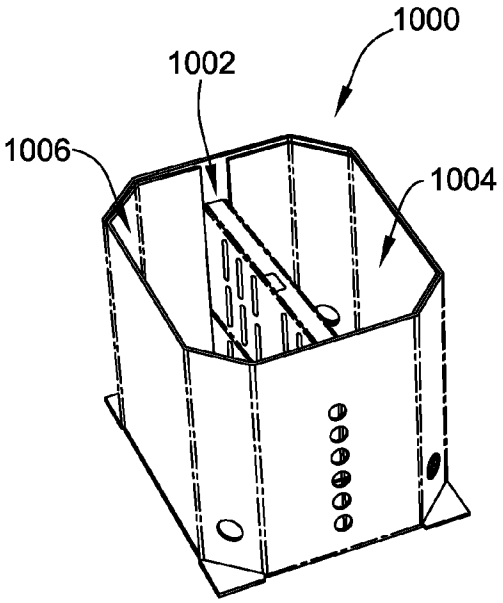
Figure 10:
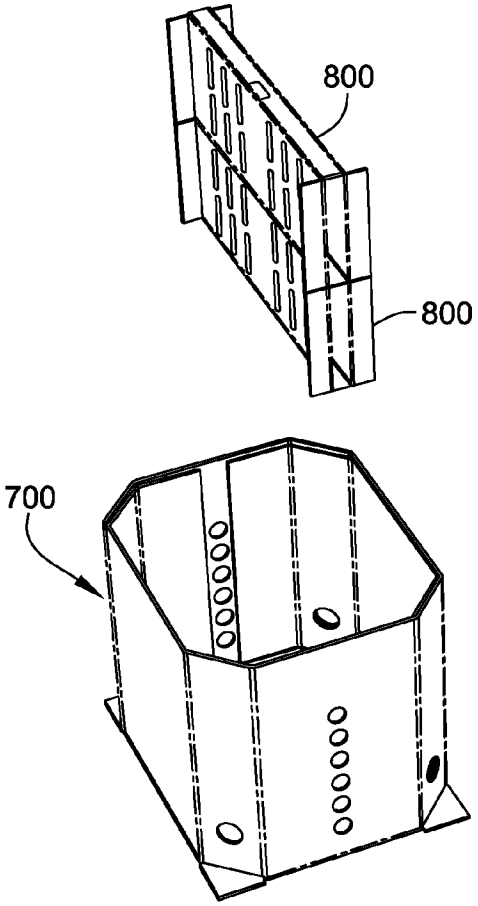

FIGS. 8-11 illustrate formation of bulk bin assembly 1000 through various stages of assembly. More specifically, FIG. 8 is a perspective view of container portion 600, bottom insert 400, sanitary insert assembly 675, and ventilation inserts 800 in a first stage of assembly of bulk bin assembly 1000; FIG. 9 is a perspective view of the container portion 600, sanitary insert assembly 675, and ventilation inserts 800 in a second stage of assembly of bulk bin assembly 1000; FIG. 10 is a perspective view of container assembly 700 and ventilation inserts 800 in a third stage of assembly of bulk bin assembly 1000; and FIG. 11 is a perspective view of fully formed bulk bin assembly 1000 in a final stage of assembly.

As described above with respect to FIG. 5, sanitary insert assembly 675 and bottom insert 400 are inserted into container portion 600 to form container assembly 700. As shown in FIGS. 10 and 11, one or more ventilation inserts 800 are inserted into container assembly 700 to form bulk bin assembly 1000. More specifically, insert tabs 548 and 552 of ventilation inserts 800 are disposed between first and second partial end side panels 220 and 236 of first sanitary insert 650 and first and second end walls 620 and 636 of container portion 600, respectively. Similarly, insert tabs 550 and 554 of ventilation inserts 800 are disposed between first and second partial end side panels 220 and 236 of second sanitary insert 652 and second and first end walls 636 and 620 of container portion 600, respectively. Insert tabs 548, 550, 552, and 554 may be coupled to at least one of sanitary insert assembly 675 and container portion 600 using a friction fit or, additionally or alternatively, using an adhesive or any other suitable method and/or technique.

Accordingly, ventilation inserts 800 substantially bisect a cavity 1002 of bulk bin assembly 1000 into a first cavity portion 1004 and a second cavity portion 1006. Additionally, each cooling channel 820 of ventilation inserts 800 is configured to align in flow communication with end vent holes 60 of container portion 600. Vent holes 60 of container portion 600 and vent holes 538 of ventilation inserts 800 cooperate to enable air flow of cool ambient air from cold storage and/or cold transportation, through cooling channel(s) 820, into first and second cavity portions 1004 and 1006, thereby facilitating even cooling of product(s) contained within cavity 1002 of bulk bin assembly 1000.

In operation, bulk bin assembly 1000 is formed such that ambient air flows between at least one end wall vent hole 60 and at least one insert opening 538 in ventilation insert(s) 800 via cooling channel 820. More specifically, ambient air flows through end wall vent hole 60, through cooling channel 820, and is discharged from insert opening 538. In some embodiments, the contents of bulk bin assembly 1000 respire and generate heat. The heat generated by the contents is transferred to ambient air flowing through insert openings 538 into cooling channel 820. As such, heated air is discharged from bulk bin assembly 1000 through end wall vent hole 60.

Figure 12:
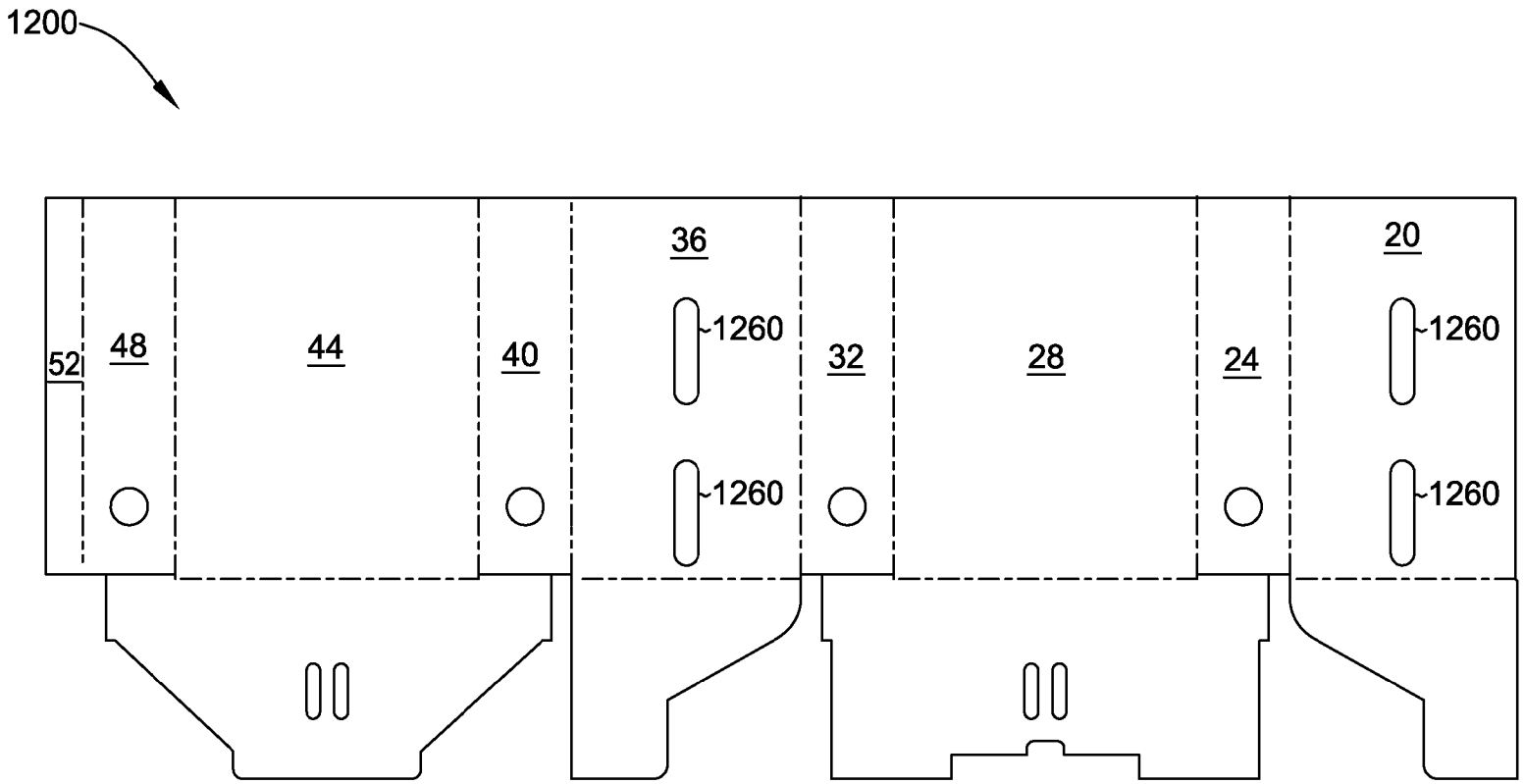
Figure 18:
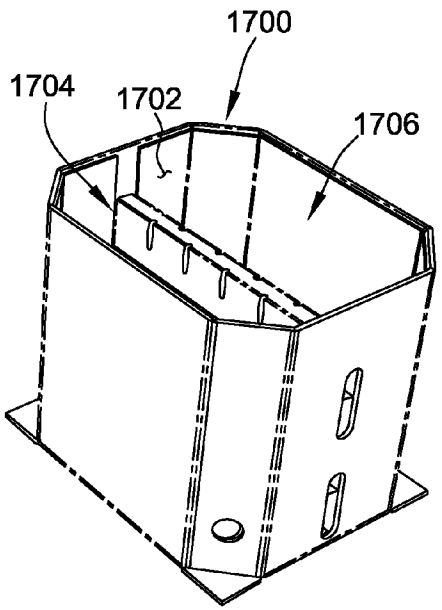

FIG. 12 is a top plan view of an alternative embodiment of a first blank 1200 of sheet material for forming a container portion 1500 (shown in FIG. 15) of a bulk bin assembly 1700 (shown in FIG. 18). Blank 1200 is similar to blank 10 (shown in FIG. 1). Accordingly, where elements of blank 1200 are similar or equivalent to the same elements of blank 10, the same reference numerals are employed. Similarly, wherein elements of container portion 1500 are similar or equivalent to elements of container portion 600 (shown in FIG. 5), the same reference numerals are employed. In particular, blank 1200 includes a plurality of end vent slots 1260 defined in first side end panel 20 and second side end panel 36 (as opposed to end vent holes 60, shown in FIG. 1). It should be understood that any of panel 20, 24, 28, 32, 36, 40, 44, and/or 48 may include end vent slots 1260, end vent holes 60, and/or side wall vent holes 62 (also shown in FIG. 1) in alternative embodiments of blank 1200. Moreover, in certain embodiments, blank 1200 may include none of end vent slots 1260 and/or side wall vent holes 62. End vent slots 1260, end vent holes 60, and side wall vent holes 62 may generally and collectively be referred to as "ventilation openings."

Figure 13:
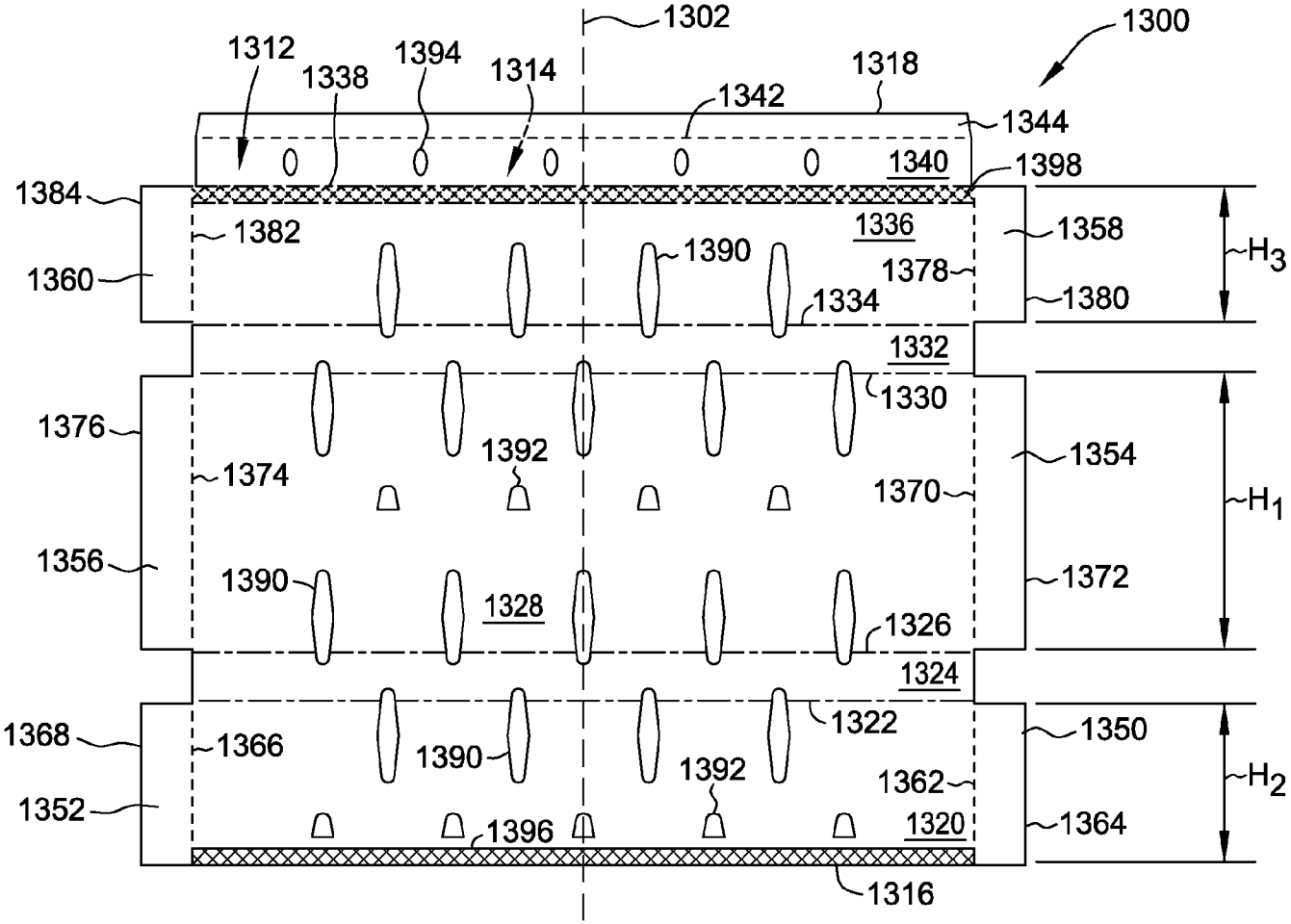

FIG. 13 is a top plan view of an alternative embodiment of a fourth blank 1300 of sheet material for forming a ventilation insert 1400 (shown in FIG. 14) of bulk bin assembly 1700 (shown in FIG. 18). Blank 1300 has a first or interior surface 1312 and an opposing second or exterior surface 1314. Further, blank 1300 defines a leading edge 1316 and an opposing trailing edge 1318. In the example embodiment, blank 1300 includes, from leading edge 1316 to trailing edge 1318, a first insert side panel 1320, a first insert top panel 1324, a second insert side panel 1328, a first insert bottom panel 1332, a third insert side panel 1336, an insert support panel 1340, and a glue flap 1344 coupled together in series along a plurality of preformed, generally parallel fold lines 1322, 1326, 1330, 1334, 1338, and 1342. More specifically, first insert side panel 1320 extends from leading edge 1316, insert top panel 1324 extends from first insert side panel 1320 along fold line 1322, second insert side panel 1328 extends from insert top panel 1324 along fold line 1326, insert bottom panel 1332 extends from second insert side panel 1328 along fold line 1330, third insert side panel 1336 extends from insert bottom panel 1332 along fold line 1334, support panel 1340 extends from third insert side panel 1336 along fold line 1338, and glue flap 1344 extends from support panel 1340 along fold line 1342.

In the illustrated embodiment, second insert side panel 1328 has a first height $H_1$. First insert side panel 1320 has a second height $H_2$ less than first height $H_1$, and third insert side panel 1336 has a third height $H_3$ less than first height $H_1$. Second height $H_2$ and third height $H_3$ combined are slightly longer than first height $H_1$, such that when ventilation insert 1400 is formed from blank 1300, first insert side panel 1320 and third insert side panel 1336 overlap, as described further herein. In addition, in some embodiments, blank 1300 includes at least one adhesive region 1396 and/or 1398. Adhesive region(s) 1396, 1398 are configured to receive adhesive thereon to secure interior surface 1312 of first insert side panel 1320 to exterior surface of third insert side panel 1340.

In the example embodiment, blank 1300 includes a plurality of elongated insert vent slots 1390 defined therein. Each insert vent slot 1390 is defined in adjacent ones of panels 1320, 1324, 1328, 1332, and 1336, extending across respective fold lines 1322, 1326, 1330, and 1334. For example, in the illustrated embodiment, four insert vent slots 1390 are defined in first insert side panel 1320 with a portion thereof extending into insert top panel 1324. Such configuration of insert vent slots 1390 improves air circulation through ventilation insert 1400. In the example embodiment, insert vent slots 1390 are arranged symmetrically about a longitudinal axis 1302 that bisects blank 1300, in order to provide even air circulation throughout container portion 1500 (shown in FIG. 15) of bulk bin assembly 1700 when ventilation insert 1400 is formed from blank 1300 and inserted into container portion 1500.

In addition, blank 1300 includes a plurality of insert side vent holes 1392 defined in insert side panels 1320 and 1328. Insert side vent holes 1392 are configured (e.g., shaped and positioned) such that insert side vent holes 1392 are unobstructed when ventilation insert 1400 is formed from blank 1300, as described further herein. Blank 1300 further includes a plurality of insert support vent holes 1394 defined in support panel 1340. Insert support vent holes 1394 are configured to facilitate air flow through an airflow channel of ventilation insert 1400, as described further herein. It should be understood that in alternative embodiments, any or all of insert vent slots 1390, insert side vent holes 1392, and/or insert support vent holes 1394 may have any suitable shape and/or configuration and may be included on any of panels 1320, 1324, 1328, 1332, 1336, and/or 1340.

First insert side panel 1320 includes a first insert locking tab 1350 and a second insert locking tab 1352 extending therefrom along opposing fold lines 1362 and 1366, respectively. More specifically, first insert locking tab 1350 extends from first insert side panel 1320 along fold line 1362 to a free edge 1364, and second insert locking tab 1352 extends from first insert side panel 1320 along fold line 1366 to a free edge 1368. Second insert side panel 1328 includes a third insert locking tab 1354 and a fourth insert locking tab 1356 extending therefrom along opposing fold lines 1370 and 1374, respectively. More specifically, third insert locking tab 1354 extends from second insert side panel 1328 along fold line 1370 to a free edge 1372, and fourth insert locking tab 1356 extends from second insert side panel 1328 along fold line 1374 to a free edge 1376. Third insert side panel 1336 includes a fifth insert locking tab 1358 and a sixth insert locking tab 1360 extending therefrom along opposing fold lines 1378 and 1382, respectively. More specifically, fifth insert locking tab 1358 extends from third insert side panel 1336 along fold line 1378 to a free edge 1380, and sixth insert locking tab 1360 extends from third insert side panel 1336 along fold line 1382 to a free edge 1384. As described herein, insert locking tabs 1350, 1352, 1354, 1356, 1358, and 1360 are configured to be positioned and/or coupled between exterior surface 214 (shown in FIG. 2) of one of sanitary inserts 650, 652 (shown in FIG. 5) and an interior surface of container portion 600 (shown in FIG. 5) when bulk bin assembly 1000 is formed from blanks 10, 200, 300, and 1300 and/or an interior surface of container portion 1500 (shown in FIG. 15) when bulk bin assembly 1700 is formed from blanks 1200, 200, 300, and 1300.

Figure 14:
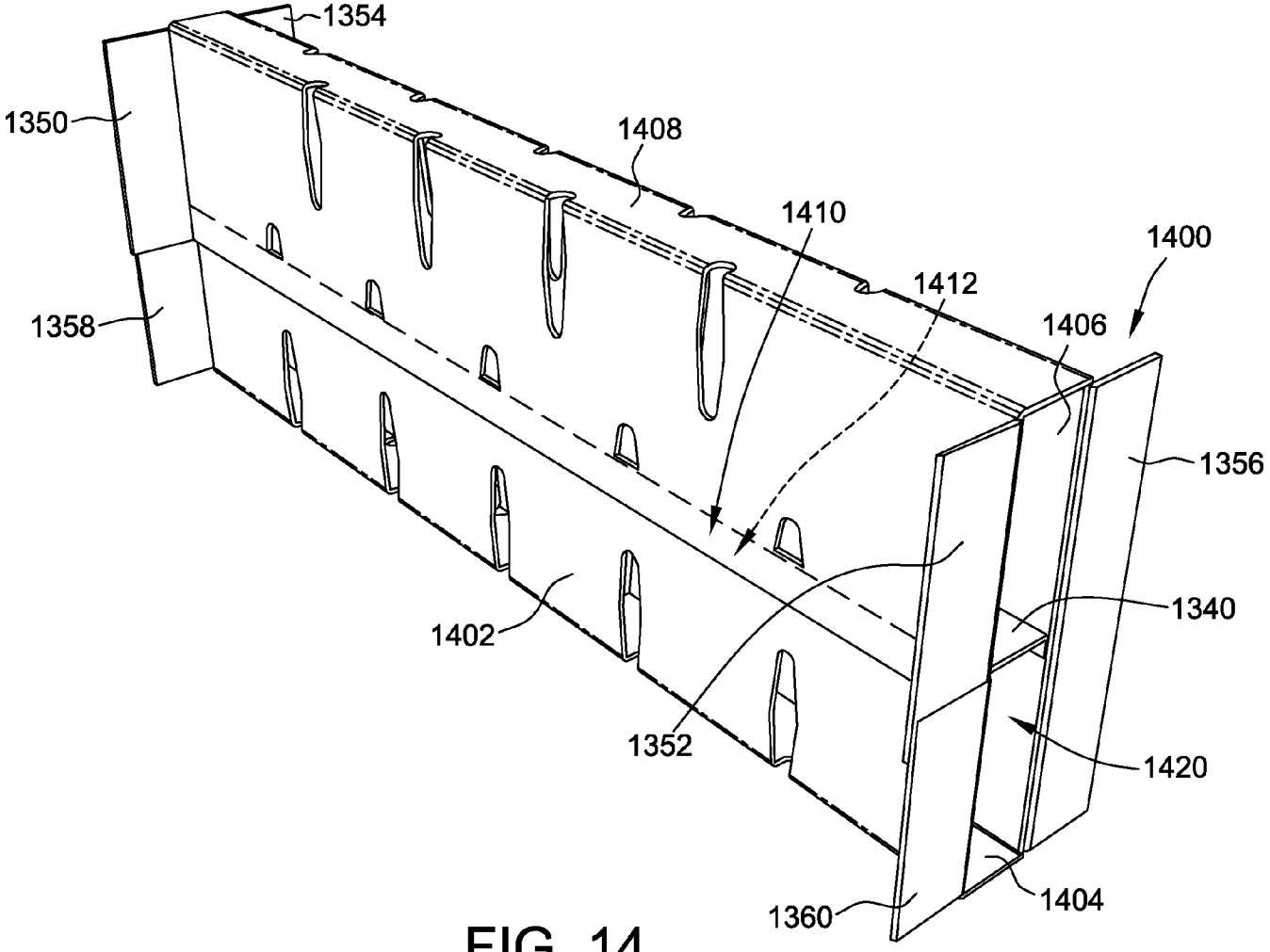

FIG. 14 is a perspective view of a ventilation insert 1400 formed from the fourth blank 1300 as shown in FIG. 13. Referring to FIGS. 13 and 14, to construct ventilation insert 1400 from blank 1300, glue flap 1344 is rotated about fold line 1342 toward interior surface 1312 of support panel 1340, support panel 1340 is rotated toward interior surface 1312 of third insert side panel 1336, third insert side panel 1336 is rotated toward interior surface 1312 of insert bottom panel 1332, insert bottom panel 1332 is rotated about fold line 1330 toward second insert side panel 1328, second insert side panel 1328 is rotated about fold line 1326 toward interior surface 1312 of insert top panel 1324, insert top panel 1324 is rotated about fold line 1322 toward interior surface 1312 of first insert side panel 1320, and first insert side panel 1320 is rotated about fold line 1322 into an overlapping, face-to-face relationship with a portion of third insert side panel 1336. In the example embodiment, after said rotating, insert top panel 1324 is substantially parallel to support panel 1340 and insert bottom panel 1332, and is substantially perpendicular to insert side panels 1320, 1328, and 1336.

After said rotating, first insert side panel 1320 may be adhered or otherwise secured to third insert side panel 1336. In particular, a portion 1410 of first insert side panel 1320 is adhered to a portion 1412 of third insert side panel 1336 that is overlapped by portion 1410. In the example embodiment, portions 1410 and 1412 are suitably sized and configured such that ventilation insert 1400 is securely constructed while keeping insert side vent holes 1392 defined in first insert side panel 1320 unobstructed by portion 1412. In the example embodiment, after first insert side panel 1320 is secured to third insert side panel 1336 in the overlapping, face-to-face relationship, first insert side panel 1320 and third insert side panel 1336 form a first insert side wall 1402. Insert bottom panel 1332 forms an insert bottom wall 1404, second insert side panel 1328 forms a second insert side wall 1406, and insert top panel 1324 forms an insert top wall 1408. First insert side wall 1402, insert bottom wall 1404, second insert side wall 1406, and insert top wall 1408 define a cavity or cooling channel 1420 (also referred to as an "air flow channel") of ventilation insert 1400.

Glue flap 1344 may be coupled to interior surface 1312 of second insert side panel 1328 at any point in the construction of ventilation insert 1400. In some embodiments, glue flap 1344 is adhered to interior surface 1312 of second insert side panel 1328, for example, using an adhesive (not shown) applied to exterior surface 1314 of glue flap 1344. In the illustrated embodiment, exterior surface 1314 of glue flap 1344 is adhered (or otherwise secured) to interior surface 1312 of second insert side panel 1328 such that glue flap 1344 does not interfere with or obstruct insert side vent holes 1392 defined in second insert side flap 1328. By securing glue flap 1344 to second insert side panel 1328, support panel 1340 is maintained in an orientation that substantially bisects cooling channel 820. Accordingly, insert support vent holes 1394 facilitate airflow throughout cooling channel 820, through support panel 1340. Moreover, support panel 1340 prevents inward buckling or bending of ventilation insert 1400, thereby improving the structural integrity and stability of ventilation insert 1400.

To continue construction of ventilation insert 1400, first insert locking tab 1350 is rotated about fold line 1362 toward exterior surface 1314 of first insert side panel 1320, and fifth insert locking tab 1358 is rotated about fold line 1378 toward exterior surface 1314 of third insert side panel 1336. In some embodiments, first insert locking tab 1350 may be coupled (e.g., adhered) to fifth insert locking tab 1358, and in such embodiments, the rotation of first and fifth insert locking tabs 1350 and 1358 may be simultaneous. Second insert locking tab 1352 is rotated about fold line 1366 toward exterior surface 1314 of first insert side panel 1320, and sixth insert locking tab 1360 is rotated about fold line 1382 toward exterior surface 1314 of third insert side panel 1336. In some embodiments, second locking tab 1352 may be coupled (e.g., adhered) to sixth insert locking tab 1360, and in such embodiments, the rotation of second and sixth insert locking tabs 1352 and 1360 may be simultaneous. Third insert locking tab 1354 is rotated about fold line 1370 toward exterior surface 1314 of second insert side panel 1328, and fourth insert side panel 1356 is rotated about fold line 1374 toward exterior surface 1314 of second insert side panel 1328. Once insert locking tabs 1350, 1352, 1354, 1356, 1358, and 1360 are rotated about respective fold lines, insert locking tabs 1350, 1352, 1354, 1356, 1358, and 1360 are substantially parallel to each other and substantially perpendicular to insert side walls 1402 and 1406.

In the example embodiment, blank 1300, and therefore ventilation insert 1400, is made of reinforced and/or double-thickness cardboard, corrugated board, plastic, and/or any other suitable material. Ventilation insert 1400 is reinforced in order that, upon introduction and/or removal of product into bulk bin assembly 1700, ventilation insert 1400 remains substantially intact. Moreover, ventilation insert 1400 includes support panel 1340, which further improves the structural integrity and stability of ventilation insert 1400 by keeping insert side walls 1402 and 1406 from buckling inwards during introduction and/or removal of product into bulk bin assembly 1700. In one embodiment, two ventilation inserts 1400 are coupled together before assembly of bulk bin assembly 1700. More specifically, insert bottom wall 1404 of a first ventilation insert 1400 is adhered, fastened, or otherwise coupled to insert top wall 1408 of a second ventilation insert 1400.

Figure 15:
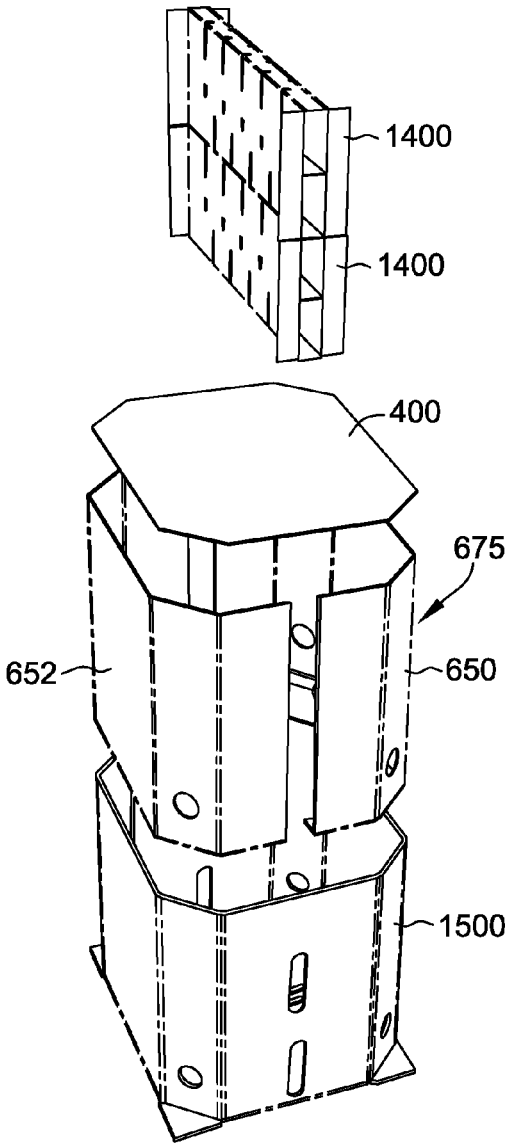
Figure 16:
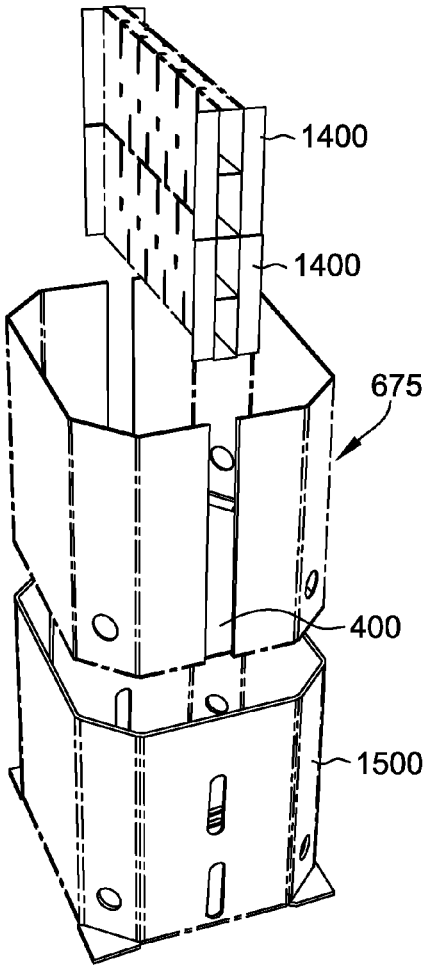
Figure 17:
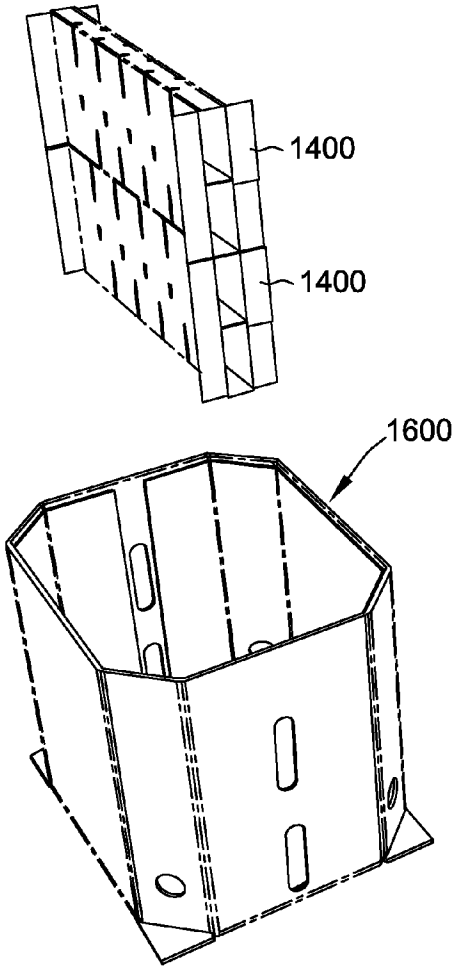

FIGS. 15-18 illustrate formation of a bulk bin assembly 1700 through various stages of assembly. More specifically, FIG. 15 is a perspective view of a container portion 1500 formed from blank 1200 (shown in FIG. 12), bottom insert 400 (shown in FIG. 3), sanitary insert assembly 675 (shown in FIG. 8), and ventilation inserts 1400 in a first stage of assembly of bulk bin assembly 1700; FIG. 16 is a perspective view of container portion 1500, sanitary insert assembly 675, and ventilation inserts 1400 in a second stage of assembly of bulk bin assembly 1700; FIG. 17 is a perspective view of a container assembly 1600 (including container portion 1500, bottom insert 400, and sanitary insert assembly 675) and ventilation inserts 1400 in a third stage of assembly of bulk bin assembly 1700; and FIG. 18 is a perspective view of fully formed bulk bin assembly 1700 in a final stage of assembly.

Sanitary insert assembly 675 and bottom insert 400 are inserted into container portion 1500 to form container assembly 1600. As shown in FIGS. 17-18, one or more ventilation inserts 1400 are inserted into container assembly 1600 to form bulk bin assembly 1700. More specifically, fourth insert locking tabs 1356 of ventilation inserts 1400 are disposed between first partial end side panel 220 (shown in FIG. 2) of first sanitary insert 650 (shown in FIG. 5) and first end wall 620 (shown in FIG. 5) of container portion 1500, and third insert locking tabs 1354 of ventilation inserts 1400 are disposed between second partial end side panel 236 (shown in FIG. 2) of first sanitary insert 650 and second end wall 636 (shown in FIG. 5) of container portion 1500. First and fifth insert locking tabs 1350 and 1358 of ventilation inserts 1400 are disposed between first partial end side panel 220 of second sanitary insert 652 (shown in FIG. 5) and first end wall 620 of container portion 1500, and second and sixth insert locking tabs 1352 and 1360 of ventilation inserts 1400 are disposed between second partial end side panel 236 of second sanitary insert 652 and second end wall 636 of container portion 1500. Insert locking tabs 1350, 1352, 1354, 1356, 1358, and/or 1360 may be coupled to at least one of sanitary insert assembly 675 and container portion 1500 using a friction fit or, additionally or alternatively, using an adhesive or any other suitable method and/or technique.

Accordingly, ventilation inserts 1400 substantially bisect a cavity 1702 of bulk bin assembly 1700 into a first cavity portion 1704 and a second cavity portion 1706. Additionally, each cooling channel 1420 of ventilation inserts 1400 is configured to align in flow communication with end vent slots 1260 of container portion 1500. End vent slots 1260 of container portion 1500, and insert vent slots 1390, insert side vent holes 1392, and support vent holes 1394 of ventilation inserts 1400 cooperate to enable air flow of cool ambient air from cold storage and/or cold transportation, through cooling channel(s) 1420, into first and second cavity portions 1704 and 1706, thereby facilitating even cooling of product(s) contained within cavity 1702 of bulk bin assembly 1700.

In operation, bulk bin assembly 1700 is formed such that ambient air flows between at least one end wall vent slot 1260 and at least one insert vent slot 1390 and/or insert side vent hole 1392 of ventilation insert(s) 1400 via cooling channel 1420. More specifically, ambient air flows through end wall vent slot 1260, through cooling channel 1420, and is discharged from insert vent slots 1390 and/or insert side vent holes 1392. In some embodiments, the contents of bulk bin assembly 1700 respire and generate heat. The heat generated by the contents is transferred to ambient air flowing through insert vent slots 1390 and/or insert side vent holes 1392 into cooling channel 1420. As such, heated air is discharged from bulk bin assembly 1700 through end wall vent slots 1260.

It should be understood that components of bulk bin assembly 1000 (shown in FIG. 11) and bulk bin assembly 1700 are interchangeable. For example, container portion 600 may be used with ventilation insert(s) 800 (shown in FIG. 7) and/or ventilation insert(s) 1400, and, similarly, container portion 1500 may be used with ventilation insert(s) 800 and/or ventilation insert(s) 1400.

Figure 19:
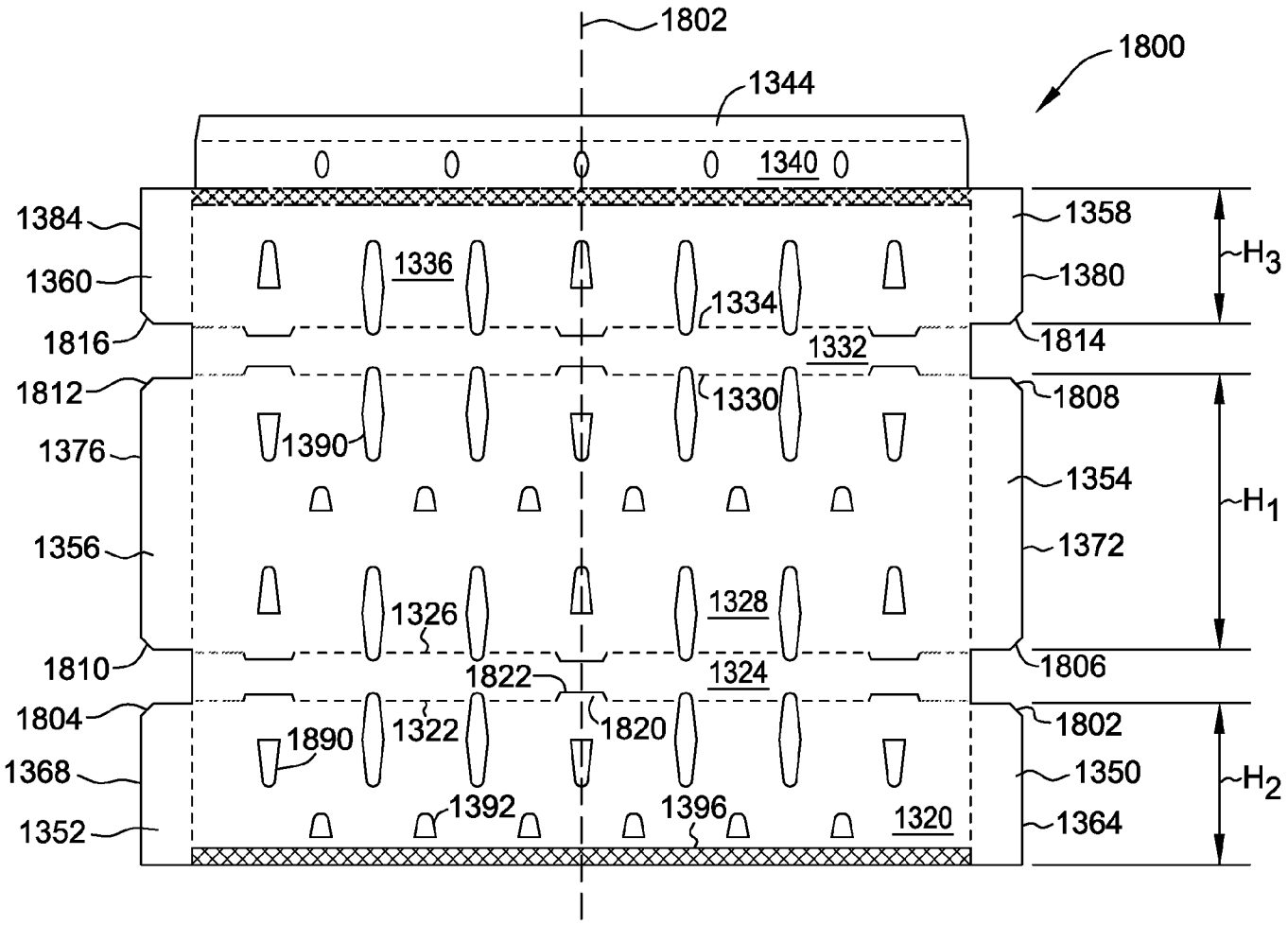

FIG. 19 is a top plan view of an alternative embodiment of a fourth blank 1800 of sheet material for forming ventilation insert 1400 of bulk bin assembly 1000 (shown in FIG. 11) and/or bulk bin assembly 1700 (shown in FIG. 18). Blank 1800 is similar to blank 1300 (shown in FIG. 13). Accordingly, where elements of blank 1800 are similar or equivalent to the same elements of blank 1300, the same reference numerals are employed.

In the illustrated embodiment, blank 1800 includes a plurality of elongated insert vent slots 1390 defined therein. As described above with respect to blank 1300, each insert vent slot 1390 is defined in adjacent ones of panels 1320, 1324, 1328, 1332, and 1336, extending across respective fold lines 1322, 1326, 1330, and 1334. However, in the illustrated embodiment, insert vent slots 1390 are configured differently from those illustrated in FIG. 13, although insert vent slots 1390 are still arranged symmetrically about a longitudinal axis 1802 that bisects blank 1800. Blank 1800 also includes a plurality of insert side vent holes 1392 defined in insert side panels 1320 and 1328. Although arranged slightly differently across blank 1800 than illustrated with respect to FIG. 13, insert side vent holes 1392 are still configured (e.g., shaped and positioned) such that insert side vent holes 1392 are unobstructed when ventilation insert 1400 is formed from blank 1800.

Blank 1800 includes insert locking tabs 1350, 1352, 1354, 1546, 1358, and 1360 as described above with respect to blank 1300. However, in the illustrated embodiment, first insert locking tab 1350 includes a first angled corner 1802 extending from free edge 1364, second insert locking tab 1352 includes a second angled corner 1804 extending form free edge 1368, third insert locking tab 1354 includes third and fourth angled corners 1806 and 1808 extending from free edge 1372, fourth insert locking tab 1356 includes fifth and sixth angled corners 1810 and 1812 extending from free edge 1376, fifth insert locking tab 1358 includes a seventh angled corner 1814 extending from free edge 1380, and sixth insert locking tab 1360 includes eighth angled corner 1816 extending from free edge 1384.

In addition, blank 1800 includes a plurality of stacking tabs 1820 defined in and extending along fold lines 1322, 1326, 1330, and 1334. Each stacking tab 1820 extends into one of insert top panel 1324 and insert bottom panel 1332. When ventilation insert 1400 is formed from blank 1800, stacking tabs 1820 extend outwardly with respect to cooling channel 1420. Moreover, stacking slots 1822 are defined in insert top panel 1324 (and, thereby, in insert top wall 1408) and in insert bottom panel 1332 (and, thereby, in insert bottom wall 1404). Stacking slots 1822 of a first ventilation insert 1400 are configured to receive corresponding stacking tabs 1820 of a second ventilation insert 1400 to facilitate stacking of ventilation inserts 1400 prior to insertion of ventilation insert 1400 into container portion 600 or container portion 1500.

Blank 1800 further includes a plurality of partial insert vent slots 1890, which, in the example embodiment, are generally halves of insert vent slots 1390. In the illustrated configuration, partial insert vent slots 1890 are arranged into positions aligned (parallel to axis 1802) with stacking tabs 1820 and stacking slots 1822. If partial insert vent slots 1890 were replaced with insert vent slots 1390 in the illustrated configuration, blank 1800 could not include stacking tabs 1820 and stacking slots 1822 as shown. Accordingly, partial insert vent slots 1890 facilitate decreasing the number of insert vent slots 1390 to accommodate stacking tabs 1820 and stacking slots 1822 while avoiding a decrease in air flow into cooling channel 1420.

Figure 20:
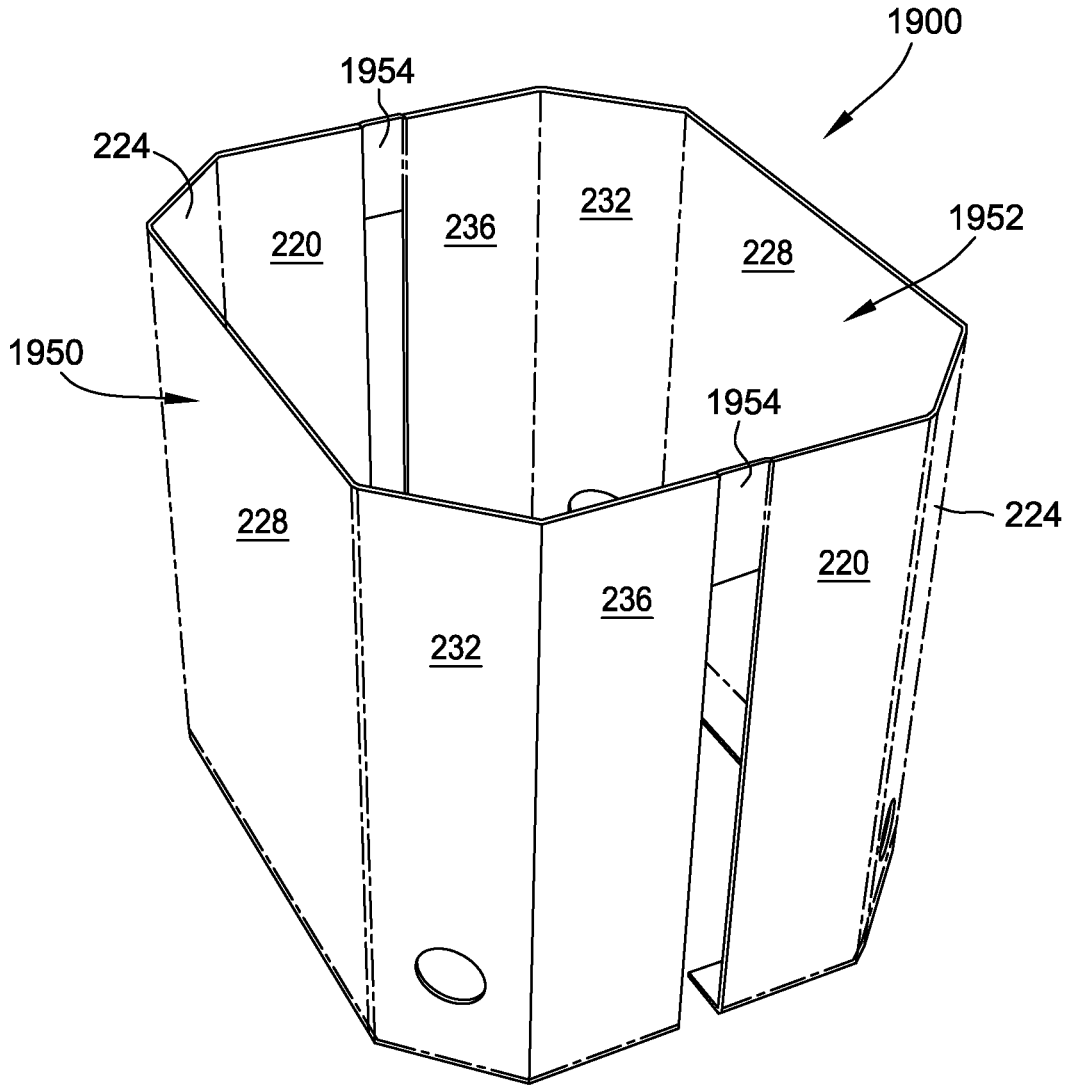

FIG. 20 is a perspective view of an alternative embodiment of a sanitary insert assembly 1900. Sanitary insert assembly 1900 is similar to sanitary insert assembly 675, shown in FIG. 5. Accordingly, where elements of sanitary insert assembly are similar to elements of sanitary insert assembly 675 and/or blank 200 (as shown in FIG. 2), the same reference numerals are employed. In the illustrated embodiment, a first sanitary insert 1950 may be similar to first sanitary insert 650, and a second sanitary insert 1952 may be similar to second sanitary insert 652 (both shown in FIG. 5). However, first and second sanitary inserts 1950 and 1952 are coupled to one another via a joining tab 1954 therebetween. Joining tabs 1954 lock first and second sanitary inserts 1950 and 1952 in place relative to one another. Accordingly, joining tabs 1954 are configured to improve the stability of sanitary insert assembly 1900, for example, during insertion into or removal from container portion 600 (shown in FIG. 5) and/or container portion 1500 (shown in FIG. 15).

In one embodiment, one joining tab 1954 extends integrally from second partial end side panel 236 of first sanitary insert 1950 and is coupled to first partial end side panel 220 of second sanitary insert 1952, and the other joining tab 1954 extends integrally from second partial end side panel 236 of second sanitary insert 1952 and is coupled to first partial end side panel 220 of first sanitary insert 1950. In another embodiment, one joining tab 1954 extends integrally from first partial end side panel 220 of first sanitary insert 1950 and is coupled to second partial end side panel 236 of second sanitary insert 1952, and the other joining tab 1954 extends integrally from first partial end side panel 220 of second sanitary insert 1952 and is coupled to second partial end side panel 236 of first sanitary insert 1952. In yet another embodiment, both joining tabs 1954 extend integrally from one of sanitary inserts 1950 and 1952 and are coupled to the other of sanitary inserts 1950 and 1952. In another embodiment, joining tabs 1954 may not be integrally formed with either of sanitary inserts 1950 and 1952 and are merely coupled to sanitary inserts 1950 and 1952.

As used herein, an element or step recited in the singular and proceeded with the word "a" or "an" should be understood as not excluding plural said elements or steps, unless such exclusion is explicitly recited. Furthermore, references to "one embodiment" of the present invention are not intended to be interpreted as excluding the existence of additional embodiments that also incorporate the recited features.

The above-described apparatus and methods facilitate providing a bulk bin assembly having at least one ventilation insert therein. Further, the above-described apparatus and methods provide a bulk bin assembly that is reinforced to facilitate providing strength against a weight of materials placed therein.

Although the apparatus and methods described herein are described in the context of a bulk bin assembly and method for making the same, it is understood that the apparatus and methods are not limited to bulk bin assemblies. Likewise, the bulk bin assembly components illustrated are not limited to the specific embodiments described herein, but rather, components of the bulk bin assembly can be utilized independently and separately from other components described herein.

While the invention has been described in terms of various specific embodiments, those skilled in the art will recognize that the invention can be practiced with modification within the spirit and scope of the claims.

The invention claimed is:

1. A plurality of blanks for forming a bulk bin assembly comprising:

a first blank comprising:

a first plurality of side panels for forming side walls of a container portion of the bulk bin assembly, wherein at least one of the first plurality of side panels comprises a ventilation opening defined therein; and a second blank configured to couple to at least one side panel of the first plurality of side panels when the container portion is formed from the first blank, the second blank comprising:

a second plurality of side panels for forming side walls of a ventilation insert, wherein the second plurality of side panels at least partially define an air flow channel when the ventilation insert is formed from the second blank, wherein, when formed, the ventilation insert is positionable within the container portion such that the ventilation opening is in air flow communication with the air flow channel;

wherein the first blank further comprises at least one bottom flap for forming a bottom wall of the container portion, the at least one bottom flap extending from a bottom edge of a respective side panel of the first plurality of side panels, said bulk bin assembly further comprising a third blank for forming a bottom insert of the bulk bin assembly, wherein the bottom insert is configured to be disposed between the bottom wall of a formed container portion and a bottom wall of a formed ventilation insert.

2. The plurality of blanks in accordance with claim 1, wherein the first plurality of side panels of the first blank comprises a first and second end side panel and a first and second side panel, and wherein the first blank further comprises a plurality of end wall vent holes defined in each of the first and second end side panels, such that the air flow channel of the formed ventilation insert is in air flow communication with an ambient environment through the ventilation opening, when the bulk bin assembly is formed.

3. The plurality of blanks in accordance with claim 2, further comprising a fourth blank configured to couple to at least one side wall of the formed container portion, the fourth blank comprising a third plurality of side panels for forming a sanitary insert, the third plurality of panels comprising a first partial end side panel and a second partial end side panel, wherein the first and second partial end side panels of the fourth blank are configured to couple to one of the first and second end side panels of the first blank, such that the first and second partial end side panels of the fourth blank do not obstruct the ventilation opening when the formed sanitary insert is coupled within the formed container portion of the bulk bin assembly.

4. The plurality of blanks in accordance with claim 1, wherein the second blank further comprises a plurality of insert locking tabs, each extending from an edge of a respective side panel of the second plurality of side panels, wherein each of the plurality of insert locking tabs is configured to be coupled to a side panel of the first plurality of side panels when the formed ventilation insert is coupled within the formed container portion of the bulk bin assembly.

5. The plurality of blanks in accordance with claim 4 further comprising a fourth blank configured to couple to at least one side wall of the formed container portion, the fourth blank comprising a third plurality of side panels for forming a sanitary insert, and wherein each of the plurality of insert locking tabs is configured to be positioned between a side wall of the formed container portion and a side panel of the third plurality of side panels when the formed ventilation insert is coupled within the formed container portion of the bulk bin assembly.

6. The plurality of blanks in accordance with claim 1, wherein the second blank further comprises a support panel extending from a side edge of one of the side panels of the plurality of panels, the support panel configured to prevent inward movement of side walls of the ventilation insert when the ventilation insert is formed from the second blank.

7. A plurality of blanks for forming a bulk bin assembly comprising:

a first blank comprising:

a first plurality of side panels for forming side walls of a container portion of the bulk bin assembly, wherein at least one of the first plurality of side panels comprises a ventilation opening defined therein; and a second blank configured to couple to at least one side panel of the first plurality of side panels when the container portion is formed from the first blank, the second blank comprising:

a second plurality of side panels for forming side walls of a ventilation insert, wherein the second plurality of side panels at least partially define an air flow channel when the ventilation insert is formed from the second blank, wherein, when formed, the ventilation insert is positionable within the container portion such that the ventilation opening is in air flow communication with the air flow channel;

a third blank configured to couple to at least one side wall of a formed container portion, the third blank comprising a third plurality of side panels for forming a sanitary insert, each of the third plurality of side panels configured to substantially align with at least one side panel of the first plurality of side panels when the formed sanitary insert is coupled within the formed container portion of the bulk bin assembly;

wherein the first blank further comprises at least one bottom flap for forming a bottom wall of the container portion, the at least one bottom flap extending from a bottom edge of a respective side panel of the first plurality of side panels, wherein the third blank further comprises a plurality of locking flaps extending from a bottom edge of a respective side panel of the third plurality of side panels, and wherein the plurality of locking flaps are configured to couple to the at least one bottom panel of the first blank when the formed sanitary insert is coupled within the formed container portion of the bulk bin assembly.

8. A bulk bin assembly comprising:

a container portion comprising a plurality of side walls defining a cavity of the container portion, wherein at least one side wall of the plurality of side walls has at least one ventilation opening defined therein; and a ventilation insert comprising a plurality of side panels and at least one insert opening defined in at least one of the plurality of side panels, wherein the ventilation insert is positioned within the cavity of the container portion such that an air flow channel defined by the plurality of side panels is in air flow communication with the ventilation opening of the container portion to permit ambient air to flow through the ventilation opening and through the insert opening;

wherein the container portion further comprises a bottom wall, said bulk bin assembly further comprising a sanitary insert assembly comprising:

a plurality of sanitary insert side panels coupled within the container portion; and a plurality of locking flaps coupled to the bottom wall of the container portion.

9. The bulk bin assembly in accordance with claim 8 further comprising a bottom insert engaged in a face-to-face relationship with the plurality of locking flaps of the sanitary insert assembly and at least a portion of the bottom wall of the container portion.

10. The bulk bin assembly in accordance with claim 9, wherein the bottom insert comprises a plurality of side edges, each side edge of the plurality of side edges coupled against a respective side wall of the container portion and a respective sanitary insert side panel.

11. The bulk bin assembly in accordance with claim 8, wherein the plurality of sanitary insert side panels substantially align with one or more of the plurality of side walls of the container portion.

12. The bulk bin assembly in accordance with claim 8, wherein the plurality of sanitary insert side panels comprises a first partial end side panel, wherein the first partial end side panel is coupled to the at least one side wall of the container portion, such that the first partial end side panel does not obstruct the ventilation opening.

13. The bulk bin assembly in accordance with claim 8, wherein the ventilation insert bisects the cavity of the container portion.

14. The bulk bin assembly in accordance with claim 8, wherein at least one of the plurality of side walls of the container portion has a side wall vent hole defined therein such that the cavity of the container portion is in air flow communication with an ambient environment.

15. The bulk bin assembly in accordance with claim 8, wherein the plurality of side panels of the ventilation insert comprise a reinforced material, such that the ventilation insert remains intact during insertion and removal of a product into said bulk bin assembly.

16. The bulk bin assembly in accordance with claim 8 further comprising a sanitary insert assembly comprising a plurality of sanitary insert side panels coupled within the container portion, wherein the ventilation insert further comprises a plurality of insert locking tabs extending from the plurality of side panels, and wherein the plurality of insert locking tabs are positioned between the container portion and at least one sanitary insert side panel.

17. The bulk bin assembly in accordance with claim 8, wherein the ventilation insert further comprises a support panel extending through the air flow channel from a first side panel of the plurality of side panels to an opposing second side panel of the plurality of side panels to prevent inward movement of the first and second side panels.

18. The bulk bin assembly in accordance with claim 17, wherein the support panel bisects the air flow channel.

19. A method for forming a bulk bin assembly from a plurality of blanks, said method comprising:

forming a container portion from a first blank that includes a first plurality of side panels for forming side walls of the container portion, wherein at least one of the first plurality of side panels includes a ventilation opening defined therein;

forming a ventilation insert from a second blank that includes a second plurality of side panels for forming side walls of the ventilation insert, wherein at least one side panel of the second plurality of side panels includes at least one insert opening defined therein, the plurality of side panels of the ventilation insert and the at least one insert opening at least partially defining an air flow channel;

positioning the ventilation insert within the container portion such that the air flow channel is in air flow communication with the ventilation opening to permit ambient air to flow through the ventilation opening and through the insert opening;

forming at least one sanitary insert from a third blank that includes a third plurality of side panels for forming the sanitary insert, each of the plurality of side panels configured to align with at least one side wall of the formed container portion; and coupling the at least one sanitary insert to an interior surface of at least one side wall of the formed container portion;

wherein the first blank further includes a plurality of bottom flaps for forming a bottom wall of the container portion, and wherein the at least one sanitary insert further includes a plurality of locking flaps extending from a bottom edge of the third plurality of side panels of the sanitary insert, said method further comprising coupling the plurality of locking flaps of the at least one sanitary insert to an interior surface of the bottom wall of the container portion.

20. The method in accordance with claim 19, wherein the ventilation insert further comprises a plurality of insert locking tabs, each extending from an edge of a respective side panel of the second plurality of side panels, and wherein positioning the ventilation insert within the container portion further comprises positioning the plurality of insert locking tabs of the ventilation insert between the side walls of the container portion and the at least one sanitary insert.

21. The method in accordance with claim 19 further comprising coupling a bottom insert formed from a fourth blank of sheet material within the container portion in a face-to-face relationship with at least a portion of the bottom wall of the container portion and the plurality of locking flaps of the at least one sanitary insert.

22. The method in accordance with claim 19, wherein the second blank further includes a support panel extending from a side edge of one side panel of the second plurality of side panels, said method further comprising positioning the support panel between a first side wall of the formed ventilation insert and an opposing second side wall of the formed ventilation insert such that the support panel prevents inward movement of the first and second side walls.

* * * * *